US011774880B2

(12) United States Patent
Oguni et al.

(10) Patent No.: US 11,774,880 B2
(45) Date of Patent: Oct. 3, 2023

(54) IMAGE FORMING APPARATUS

(71) Applicant: CANON KABUSHIKI KAISHA, Tokyo (JP)

(72) Inventors: Atsushi Oguni, Kanagawa (JP); Tetsuji Suzuki, Kanagawa (JP); Takuji Uesugi, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/943,539

(22) Filed: Sep. 13, 2022

(65) Prior Publication Data

US 2023/0004103 A1 Jan. 5, 2023

Related U.S. Application Data

(63) Continuation of application No. 17/340,146, filed on Jun. 7, 2021, now Pat. No. 11,474,449.

(30) Foreign Application Priority Data

Jun. 12, 2020 (JP) ..... 2020-102666
Jun. 12, 2020 (JP) ..... 2020-102724

(51) Int. Cl.
*G03G 15/00* (2006.01)
*G03G 21/16* (2006.01)
(Continued)

(52) U.S. Cl.
CPC ..... *G03G 15/0863* (2013.01); *G03G 15/0886* (2013.01); *G03G 15/5029* (2013.01); *G03G 21/1647* (2013.01); *G03G 21/1842* (2013.01)

(58) Field of Classification Search
CPC ..... G03G 15/0863; G03G 15/0886; G03G 15/5029; G03G 21/1604; G03G 21/1647;
(Continued)

(56) References Cited

U.S. PATENT DOCUMENTS 6,754,458 B2 6/2004 Makihira
7,742,736 B2 6/2010 Kobayashi et al.
(Continued)

FOREIGN PATENT DOCUMENTS

JP H0434443 A 2/1992
JP 2002-174977 A 6/2002
(Continued)

*Primary Examiner* — Sophia S Chen
(74) *Attorney, Agent, or Firm* — VENABLE LLP

(57) ABSTRACT

An image forming apparatus includes a first moving member moving between a first position which is a position not in contact with a recording material and a second position which is a position in contact with the recording material, and a second moving member positioned in a third position in a state where an attachable/detachable unit is not attached to an apparatus main body and in a fourth position in a state where the attachable/detachable unit is attached to the apparatus main body. An optical sensor includes a light-emitting portion and a light-receiving portion, and a flag member moves between a transmission position and a light-shielding position and moves in conjunction with movement of the first moving member from the first position to the second position and with a movement of the second moving member from the third position to the fourth position.

6 Claims, 32 Drawing Sheets

(51) Int. Cl.
*G03G 15/08* (2006.01)
*G03G 21/18* (2006.01)

(58) Field of Classification Search
CPC ..... G03G 21/1842; G03G 21/1853; G03G 21/1896
See application file for complete search history.

(56) References Cited

U.S. PATENT DOCUMENTS

| | | | | |
|---|---|---|---|---|
| 8,285,191 | B2 | 10/2012 | Kobayashi et al. | |
| 8,838,011 | B2 | 9/2014 | Kobayashi et al. | |
| 9,063,514 | B2 | 6/2015 | Suzuki | |
| 9,146,492 | B2 | 9/2015 | Suzuki | |
| 9,632,481 | B2 | 4/2017 | Suzuki | |
| 10,459,382 | B2 | 10/2019 | Iizuka | |
| 10,509,361 | B2 | 12/2019 | Wada et al. | |
| 11,474,449 | B2 * | 10/2022 | Oguni ..... | G03G 21/1842 |
| 2009/0067907 | A1 | 12/2009 | Maddux et al. | |

FOREIGN PATENT DOCUMENTS

| | | | |
|---|---|---|---|
| JP | 2002-323822 | A | 11/2002 |
| JP | 2007-145599 | A | 6/2007 |
| JP | 2019-095643 | A | 6/2019 |

* cited by examiner

IMAGE FORMING APPARATUS

This application is a continuation of application Ser. No. 17/340,146, filed Jun. 7, 2021.

BACKGROUND OF THE INVENTION

Field of the Invention

The present invention relates to an image forming apparatus which forms an image on a recording material by electrophotography.

Description of the Related Art

In general, an electrophotographic image forming apparatus (hereinafter simply as the "image forming apparatus") requires toner refilling and maintenance of various processing units. In order to facilitate such toner refilling or maintenance, there is a commercially available cartridge including for example a photosensitive drum, charging unit, developing unit, and cleaning unit combined together in a frame, so that the cartridge is detachably mounted to the main body of the image forming apparatus. The cartridge type image forming apparatus has a detecting mechanism for detecting insertion of a cartridge such as a process cartridge. This prevents unwanted jam when a printing operation is carried out without inserting a cartridge. The mechanism is referred to as a cartridge presence/absence detecting mechanism. In other words, the image forming apparatus does not operate when the cartridge presence/absence detecting mechanism detects "cartridge absence," and the image forming apparatus is allowed to operate when "cartridge presence" is detected.

As disclosed in Japanese Patent Application Publication No. 2002-323822, the image forming apparatus may be provided with a shutter member at the entrance of a fixing apparatus. This is for the purpose of protecting a user and keeping the user from touching a heat-generating portion for example during jam processing. Hereinafter, the shutter member will be referred to as the "fixing entrance shutter." Examples of known mechanisms for driving the fixing entrance shutter include the mechanism operating in a manner in conjunction with opening/closing of the door as disclosed in Japanese Patent Application Publication No. 2002-323822 and the mechanism operating in a manner in conjunction with insertion/removal of the cartridge as disclosed in Japanese Patent Application Publication No. 2019-95643. These mechanisms are selected as appropriate depending on the structure of the apparatus main body or the structure of the cartridge.

Since the driving mechanism for the fixing entrance shutter and the cartridge presence/absence detecting mechanism are directed to different purposes, these mechanisms are individually provided as independent mechanisms from each other.

SUMMARY OF THE INVENTION

As described above, the cartridge presence/absence detecting mechanism and the mechanism for activating the fixing entrance shutter are separately provided in a conventional apparatus. In addition, the mechanisms each require an interface part which operates under direct influence of opening/closing operation of the door or the insertion/removal of the cartridge as a trigger for operation in conjunction with each other. This requires a large amount of space, which increases the size of the main body. Furthermore, the number of components for each mechanism increases, which increases the cost.

It is an object of the present invention to allow a shutter driving mechanism and a cartridge presence/absence detecting mechanism in an image forming apparatus to operate in a manner in conjunction with each other less costly and in a reduced space.

In order to solve the problem, an image forming apparatus according to the present invention includes:

a cartridge including an abutting portion; and an apparatus main body, the apparatus main body comprising:

- a mounting portion to which the cartridge is mounted in a mounting direction;
- a fixing portion for fixing the toner image formed on a recording material;
- a detecting mechanism for detecting the cartridge, the detecting mechanism including:
- an acting member equipped with an acting portion acting on the sensor and movable between a first position and a second position, the acting member being positioned in the first position in a state where the cartridge is not mounted on the mounting portion and being positioned in the second position in a state where the cartridge is mounted on the mounting portion;
- a shutter configured to be movable between a closed position in which an entrance for allowing the recording material to be into the fixing portion is closed and an open position in which the entrance is opened, the shutter being positioned in the closed position in a state where the cartridge is not mounted on the mounting portion and being positioned in the open position in a state where the cartridge is mounted on the mounting portion; and
- a moving member for moving both the shutter and the acting member, the moving member including an abutted portion, wherein in a state where the cartridge is moved toward the mounting portion in the mounting direction, the moving member is moved in the mounting direction by the abutting portion of the cartridge abutting with the abutted portion of the moving member, thereby, the acting member moving from the first position to the second position, and the shutter moving from the closed position to the open position.

In order to achieve the object, an image forming apparatus according to the present invention includes:

an apparatus main body;

- an attachable/detachable unit that is attachable to/detachable from the apparatus main body;
- a first moving member capable of moving between a first position in which the first moving member is not in contact with the recording material and a second position in which the first moving member is in contact with the recording material;
- a second moving member positioned in a third position in a state where the attachable/detachable unit is not attached to the apparatus main body and in a fourth position in a state where the attachable/detachable unit is attached to the apparatus main body;
- an optical sensor comprising a light-emitting portion and a light-receiving portion; and
- a flag member capable of moving between a transmission position in which light from the light-emitting portion is allowed to be received by the light-receiving portion and a light-shielding position in which the light is not allowed to be received by the light-receiving portion, the flag member moving in conjunction with a movement of the first moving member from the first position to the second position, the flag member moving in conjunction with a movement of the second moving member from the third position to the fourth position.

According to the present invention, the shutter driving mechanism and the cartridge presence/absence detecting mechanism in the image forming apparatus can be operated in a manner in conjunction with each other less costly and in a reduced space.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

A first embodiment of the present invention will be described. Examples of an electrophotographic image forming apparatus to which the present invention is applied (hereinafter referred to as the image forming apparatus) include an electrophotographic copier, an electrophotographic printer (such as an LED printer and a laser printer), a facsimile device, and a word processor. Examples of a recording material onto which an image is formed by the image forming apparatus according to the embodiment include a recording paper sheet and a plastic sheet.

In the following description, the positional relation among components is defined with respect to the direction of a rotation axis of an electrophotographic photosensitive drum as the lengthwise direction. In the lengthwise direction, the side on which the electrophotographic photosensitive drum receives driving force from the main body of the image forming apparatus is the driving side, while the opposite side is the non-driving side. That schematic cross section of the image forming apparatus for example in FIG. 1 corresponds to the state in which the image forming apparatus is placed on a horizontal surface as a floor surface normally expected as an apparatus installing floor surface. In the schematic cross section for example in FIG. 1, the direction in which the front side and the backside of the apparatus are defined is the x axis, the direction in which non-driving side and the driving side are defined is the y axis, and the direction perpendicular to the apparatus installation surface (the vertical direction) is the z-axis when the user faces the image forming apparatus with the non-driving side on the left and the driving side on the right.

Figure 1:
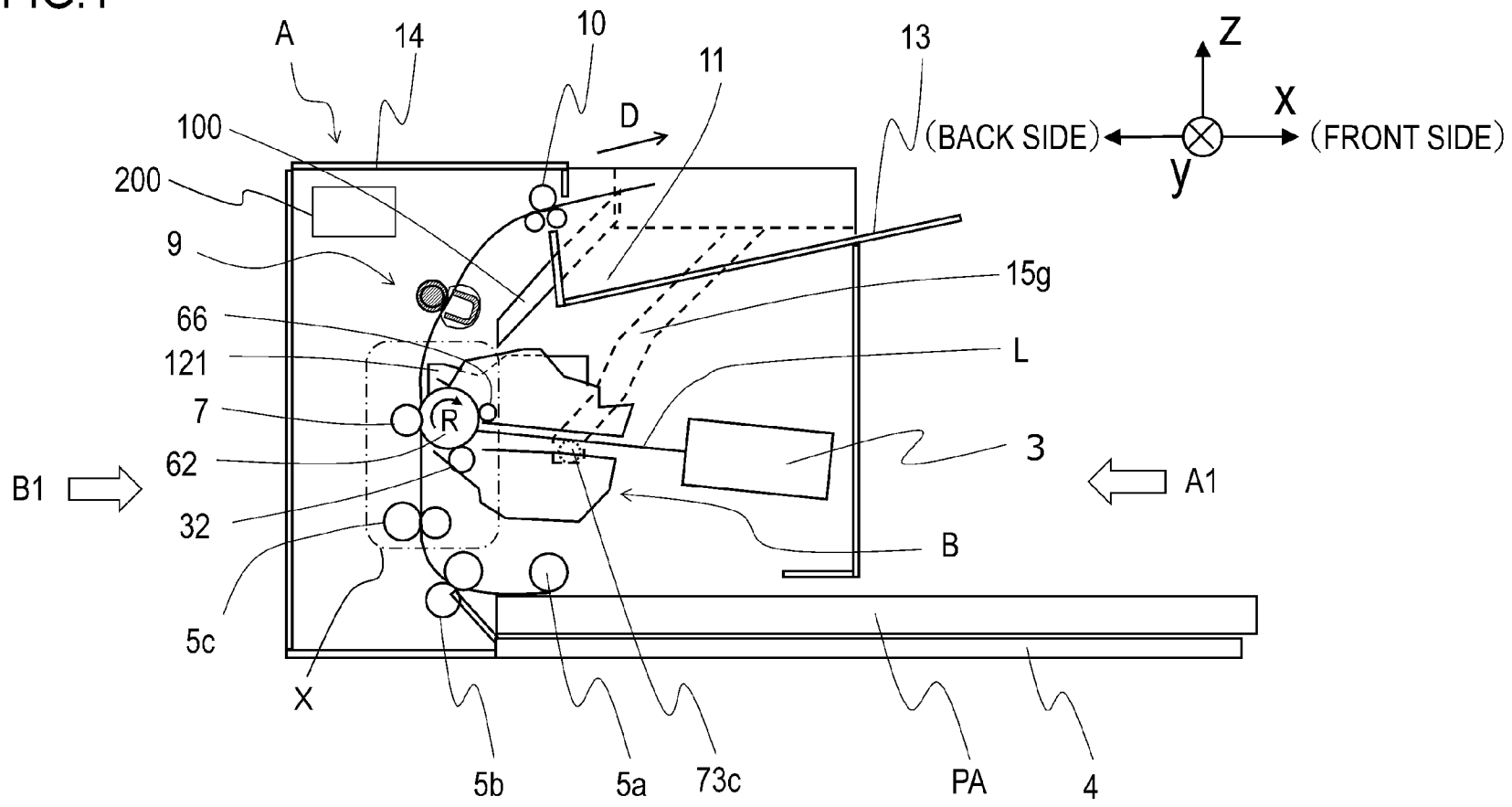
FIG. 1 is a schematic sectional view of an image forming apparatus according to first and third embodiments of the invention.

FIG. 1 is a sectional view of the apparatus main body A of the image forming apparatus and a process cartridge B (hereinafter referred to as the cartridge B) according to the first embodiment of the invention. Here, the apparatus main body A refers to the electrophotographic image forming apparatus removed of the cartridge B.

Overall Structure of Electrophotographic Image Forming Apparatus

The image forming apparatus shown in FIG. 1 is a laser beam printer based on electrophotography which allows the cartridge B to be detachably provided at the apparatus main body A. When the cartridge B is mounted to the apparatus main body A, an exposure device 3 (a laser scanner unit) for forming a latent image on an electrophotographic photosensitive drum 62 as an image carrying member of the cartridge B is provided. A sheet tray 4 for storing a recording material (hereinafter referred to as a sheet PA) on which an image is to be formed is provided under the cartridge B. The electrophotographic photosensitive drum 62 is a photosensitive member (an electrophotographic photosensitive member) for forming electrophotographic images.

The apparatus main body A includes a pickup roller 5*a*, a feed roller pair 5*b*, a conveying roller pair 5*c*, a transfer roller 7, a fixing apparatus 9, a discharge roller pair 10, and a discharge tray 11 sequentially arranged in the conveying direction D of the sheet PA.

Image Forming Process

The following is an outline of an image forming process. The electrophotographic photosensitive drum 62 (hereinafter simply referred to as the photosensitive drum 62) is driven to rotate at a prescribed peripheral speed (a process speed) in the direction of the arrow R in response to a printing start signal. A charging roller (a charging member) 66 provided with biasing voltage contacts the outer peripheral surface of the photosensitive drum 62 and uniformly charges the outer peripheral surface of the photosensitive drum 62. The exposure device 3 outputs laser light L according to image information. The laser light L passes through the laser opening of the cartridge B, so that the outer peripheral surface of the photosensitive drum 62 is exposed to and scanned with the light. In this way, an electrostatic latent image corresponding to the image information is formed on the outer peripheral surface of the photosensitive drum 62. In the meantime, the toner in the cartridge B is carried by a developing roller 32 and supplied to the photosensitive drum 62 according to the electrostatic latent image to form a latent image. In this way, the latent image is made visible as a toner image (a developer image).

As shown in FIG. 1, the sheet PA is fed from the sheet tray 4 stored under the apparatus main body A by the pickup roller 5*a*, the feed roller pair 5*b*, and the conveying roller pair 5*c* as a conveying portion in accordance with the output timing of the laser light L. The sheet PA is conveyed to a transfer position between the photosensitive drum 62 and the transfer roller 7. In the transfer position, the toner image is sequentially transferred onto the sheet PA from the photosensitive drum 62.

The sheet PA having that toner image transferred thereon is separated from the photosensitive drum 62 and conveyed to the fixing apparatus 9 (fixing portion). The sheet PA is subjected to pressing/heating fixing processing at a nip portion as a part of the fixing apparatus 9, and the toner image is fixed on the sheet PA. The sheet PA after the toner image fixing processing is conveyed to the discharge roller pair 10 and discharged onto the discharge tray 11.

Mounting Cartridge

Figure 2A:
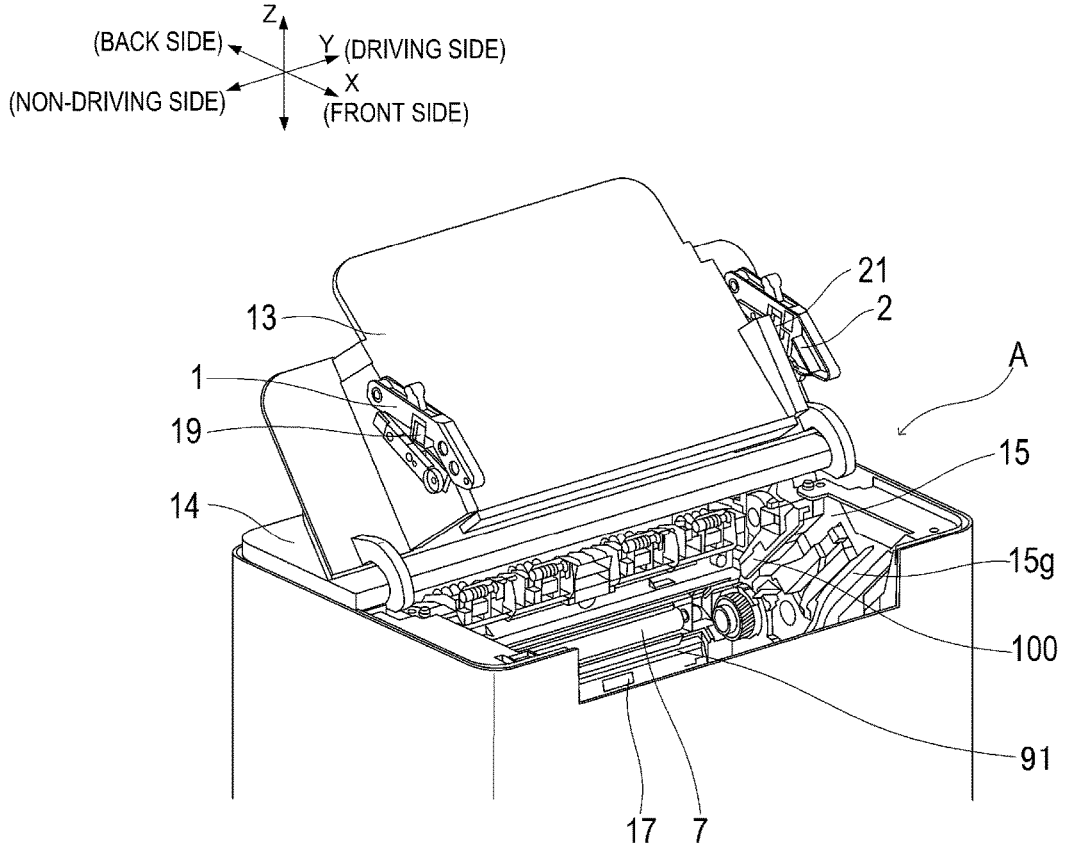
FIGS. 2A and 2B are views for illustrating the main body of the image forming apparatus according to the first embodiment showing the state having its opening/closing door opened.
Figure 2B:
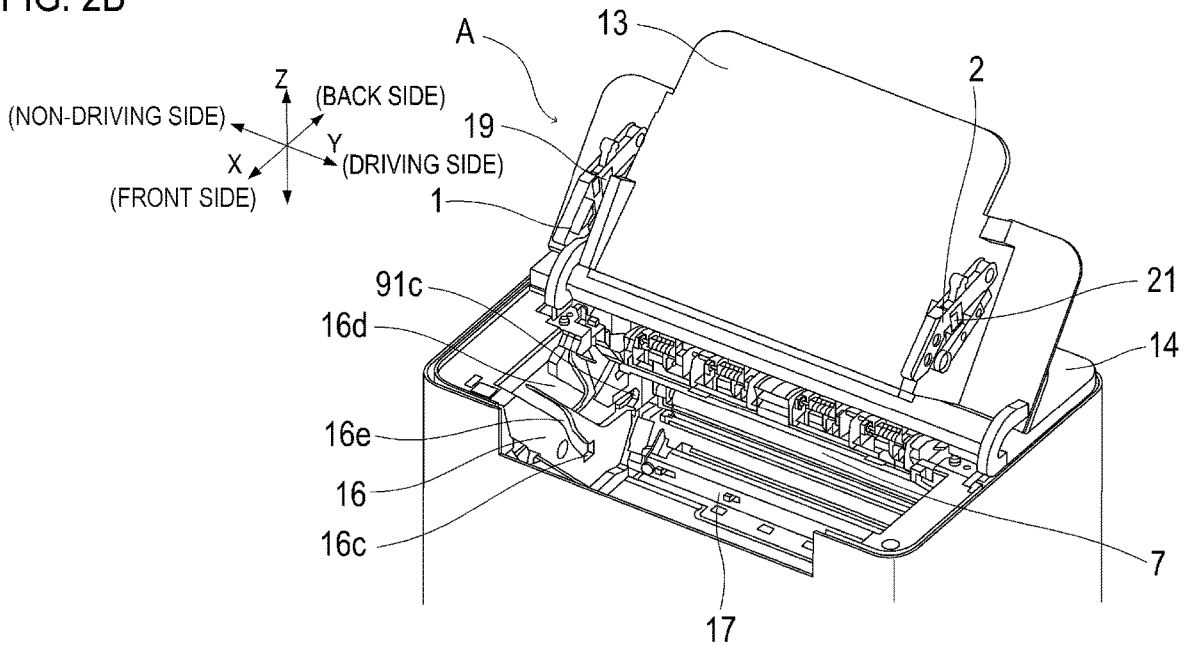
Figure 3:
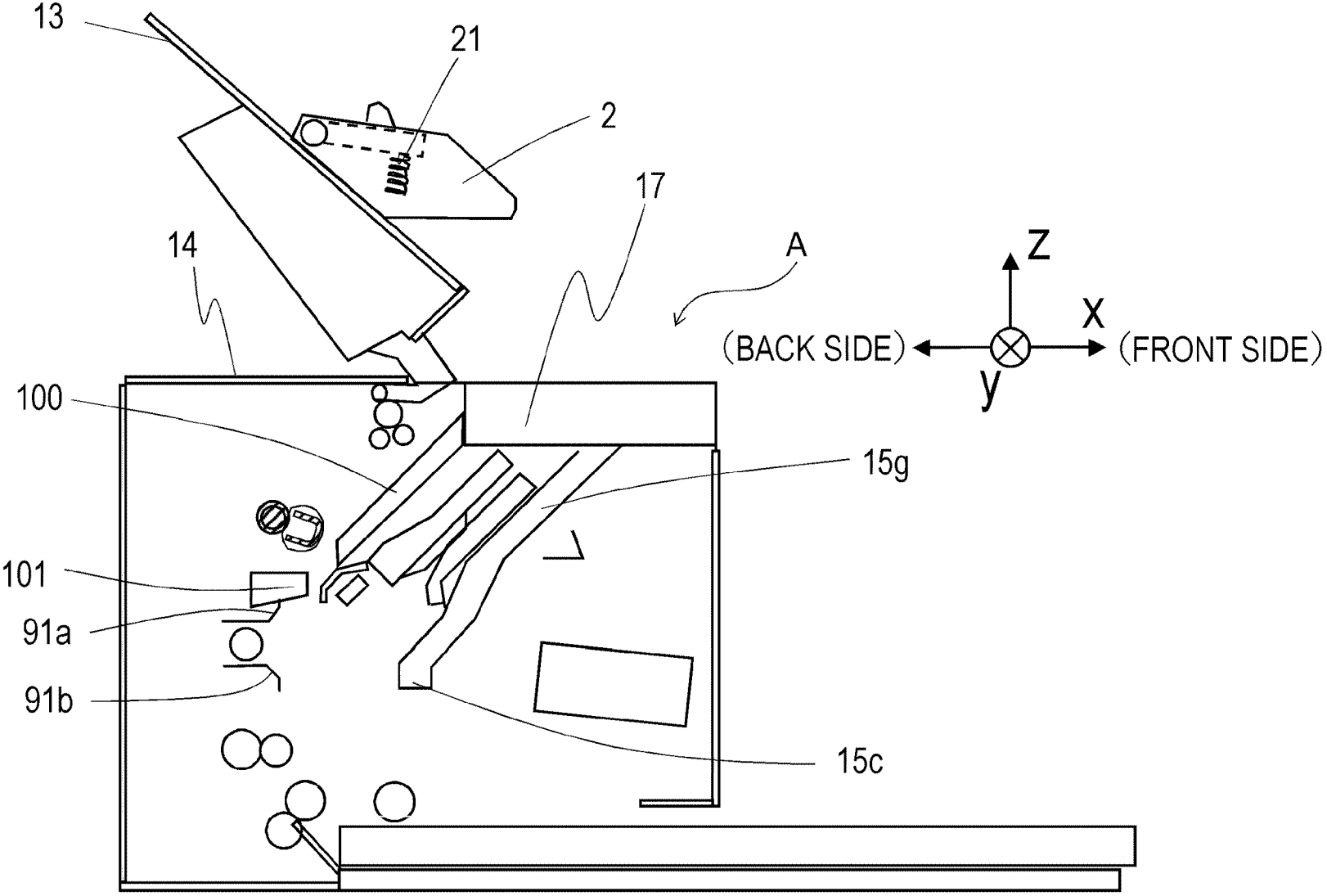
FIG. 3 is a schematic sectional view of the main body of the image forming apparatus according to the first embodiment having its opening/closing door opened.
Figure 4A:
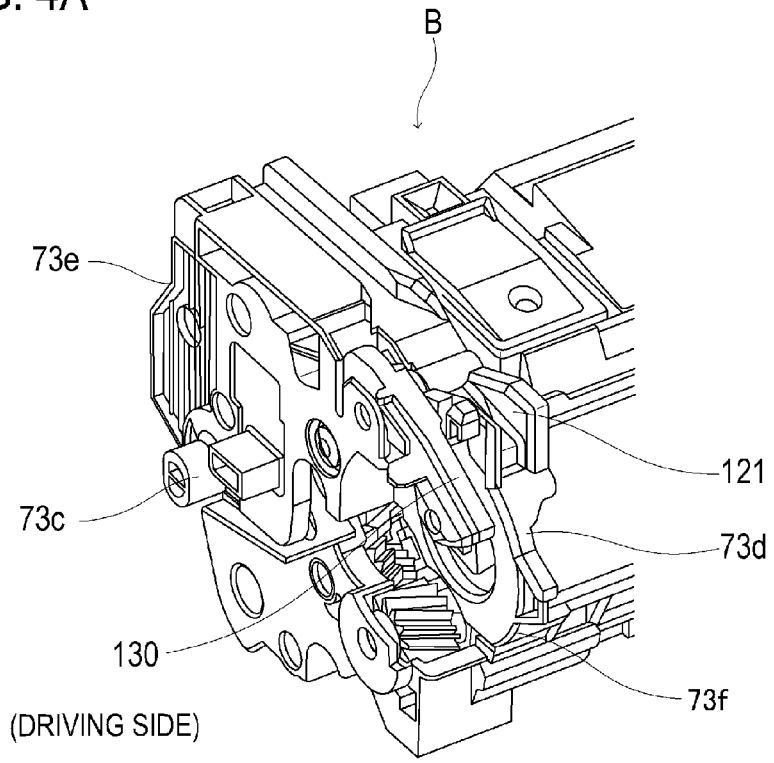
FIGS. 4A and 4B are views for illustrating a process cartridge according to the first embodiment.
Figure 4B:
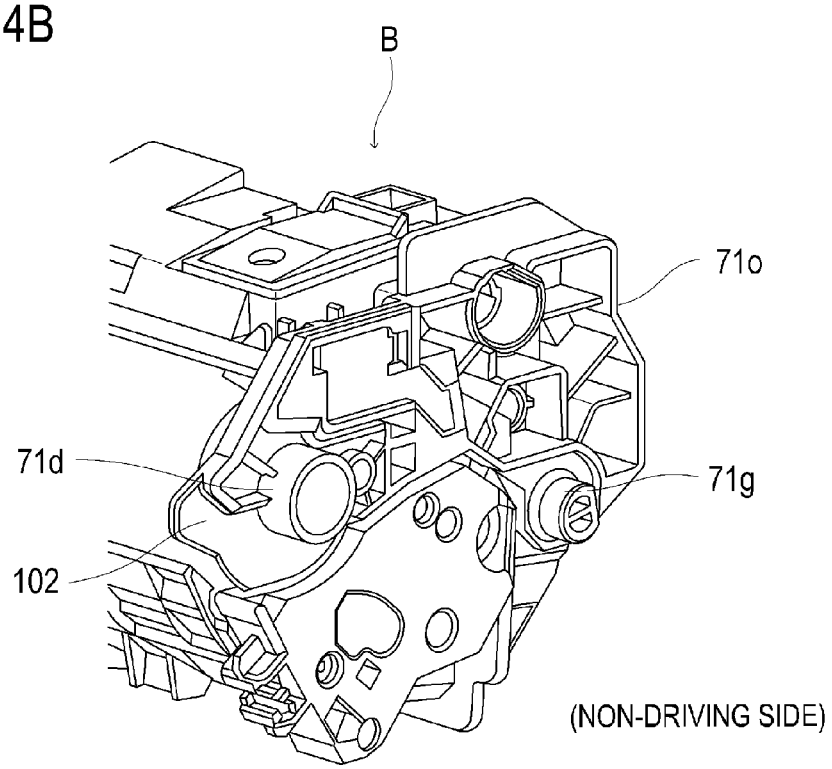
Figure 5:
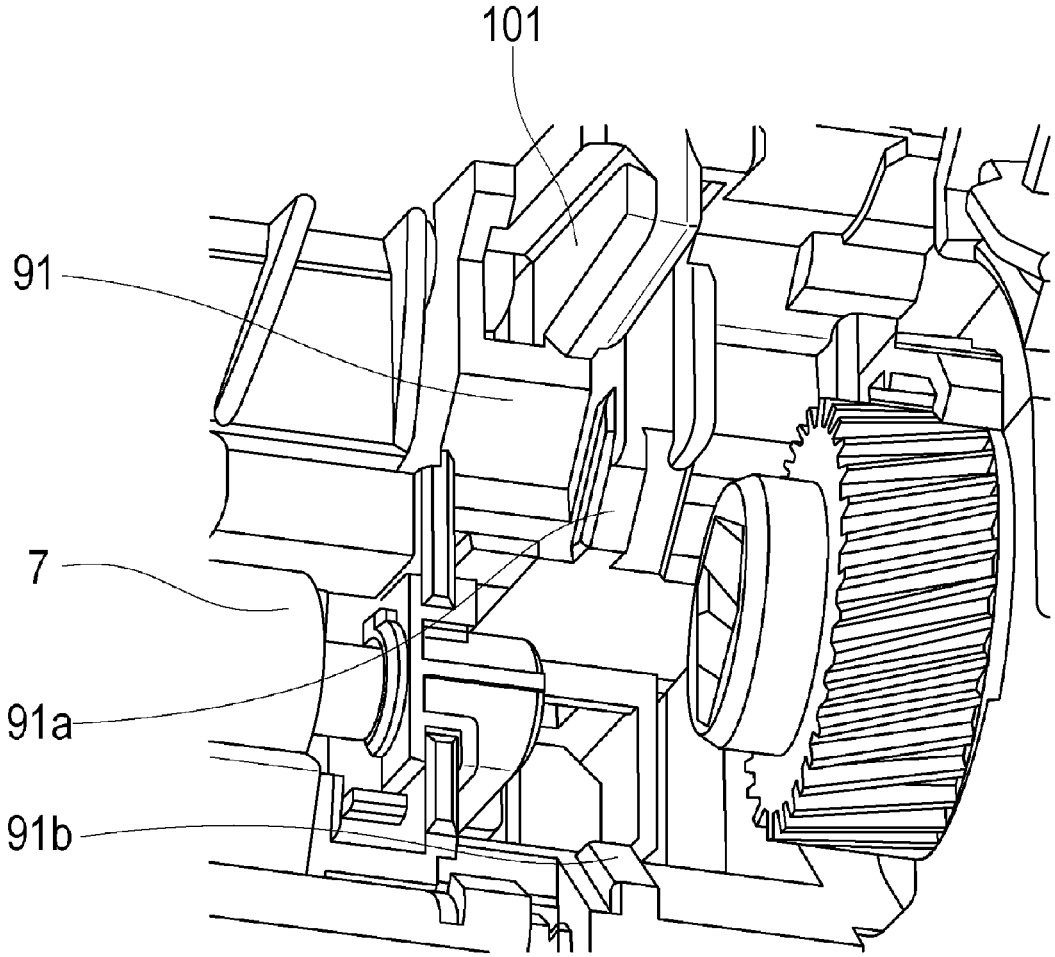
FIG. 5 is a view for illustrating a driving transmitting portion and a positioning portion in the main body of the image forming apparatus according to the first embodiment.
Figure 6:
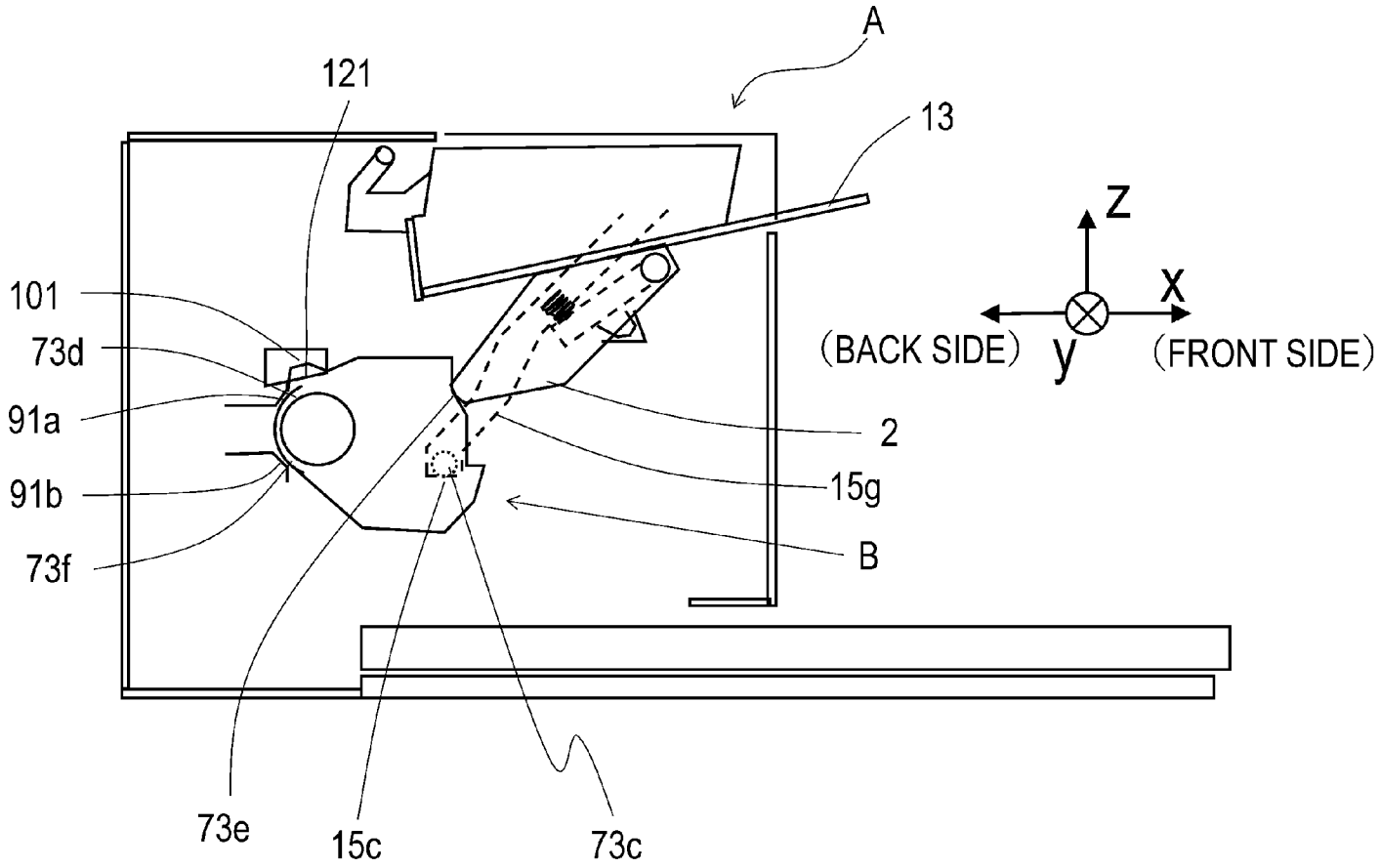
FIG. 6 is a schematic sectional view of the main body of the image forming apparatus according to the first embodiment having its opening/closing door closed.
Figure 7:
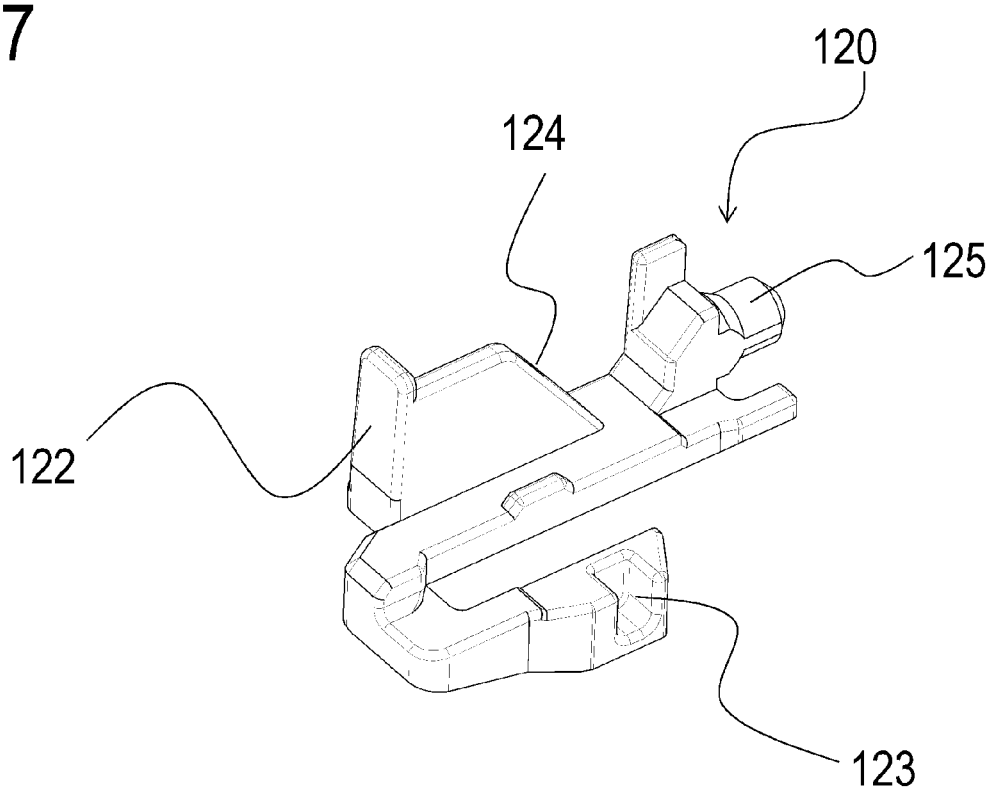
FIG. 7 is a view for illustrating an interface member according to the first embodiment.
Figure 7:
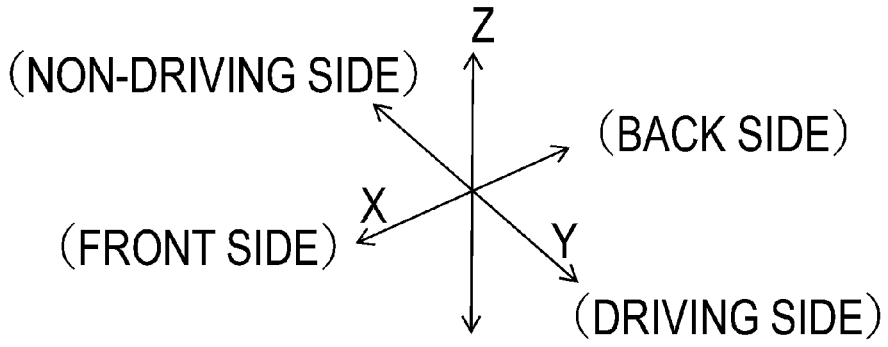
Figure 8:
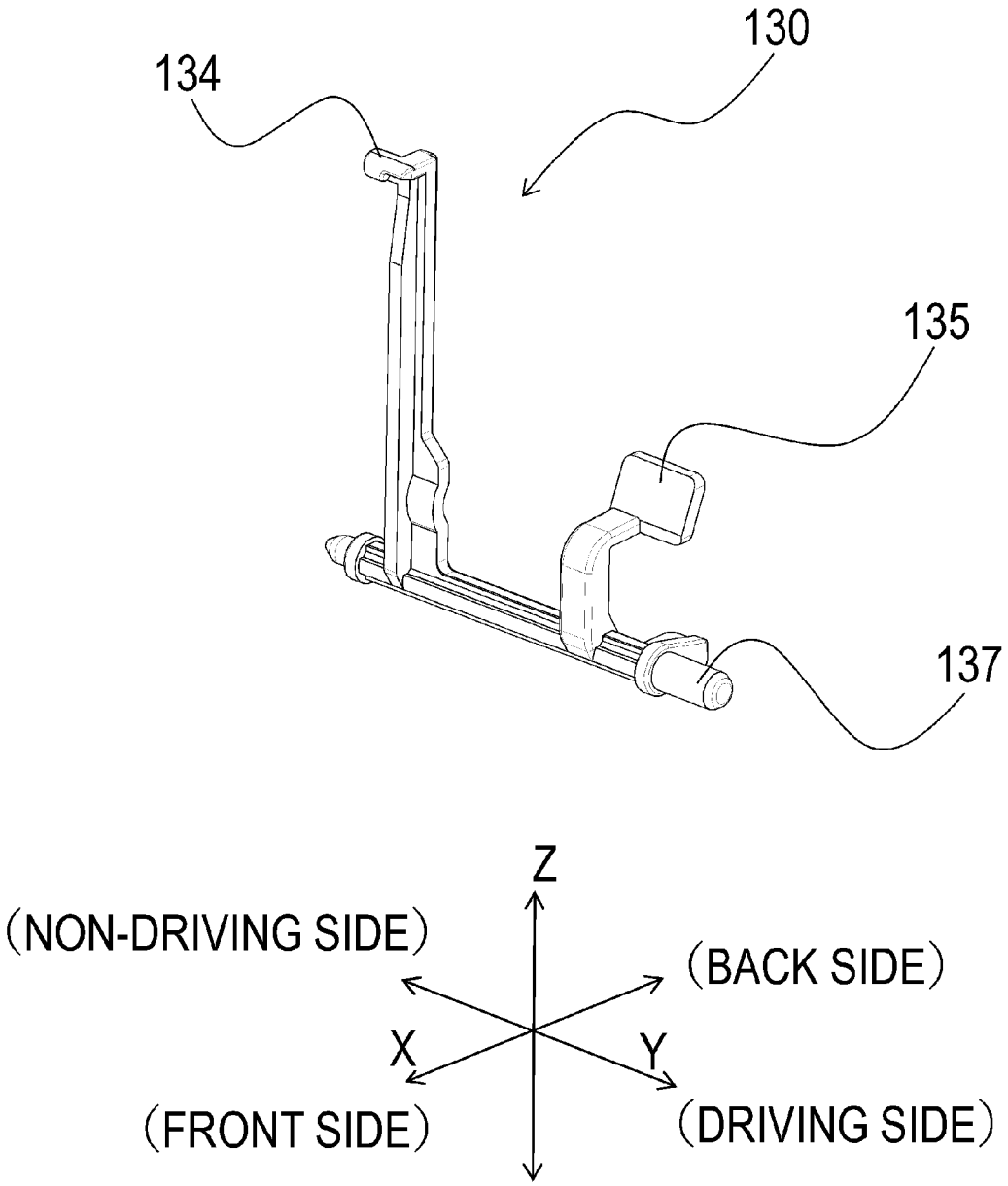
FIG. 8 is a view for illustrating a cartridge presence/absence detecting lever according to the first embodiment.
Figure 9:
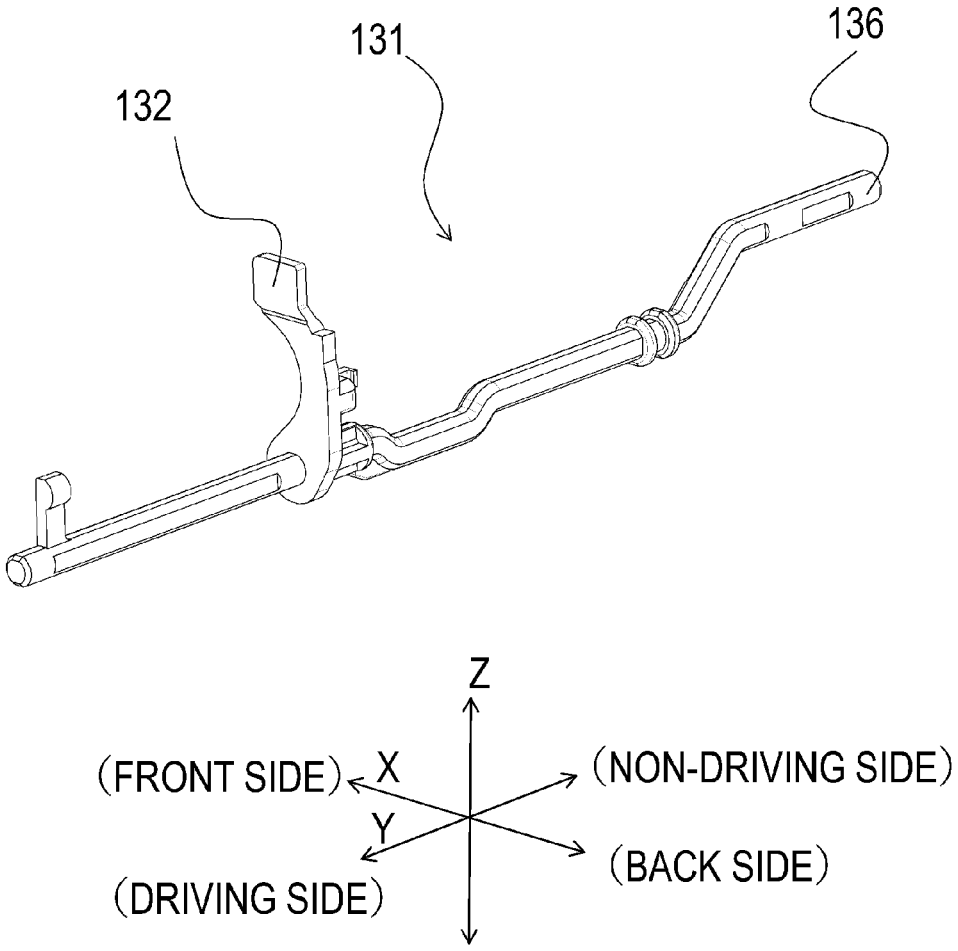
FIG. 9 is a view for illustrating a sensor link member according to the first embodiment.
Figure 10:
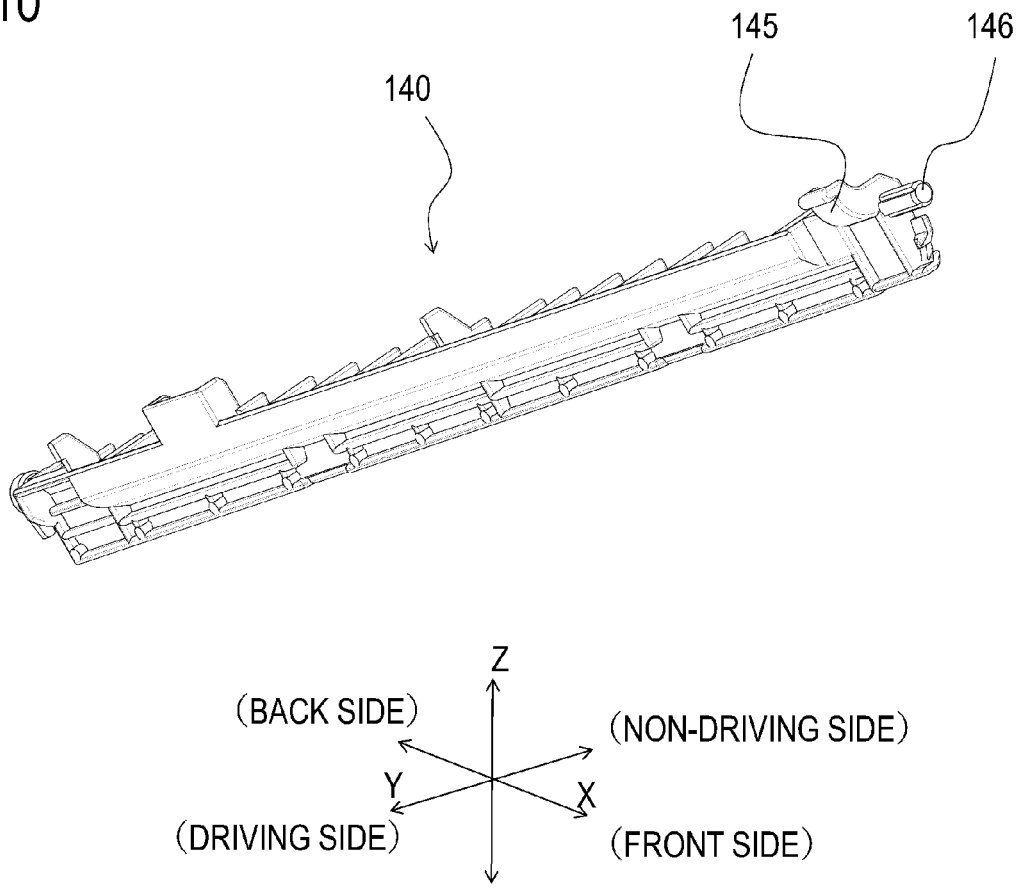
FIG. 10 is a view for illustrating a fixing entrance shutter according to the first embodiment.
Figure 11:
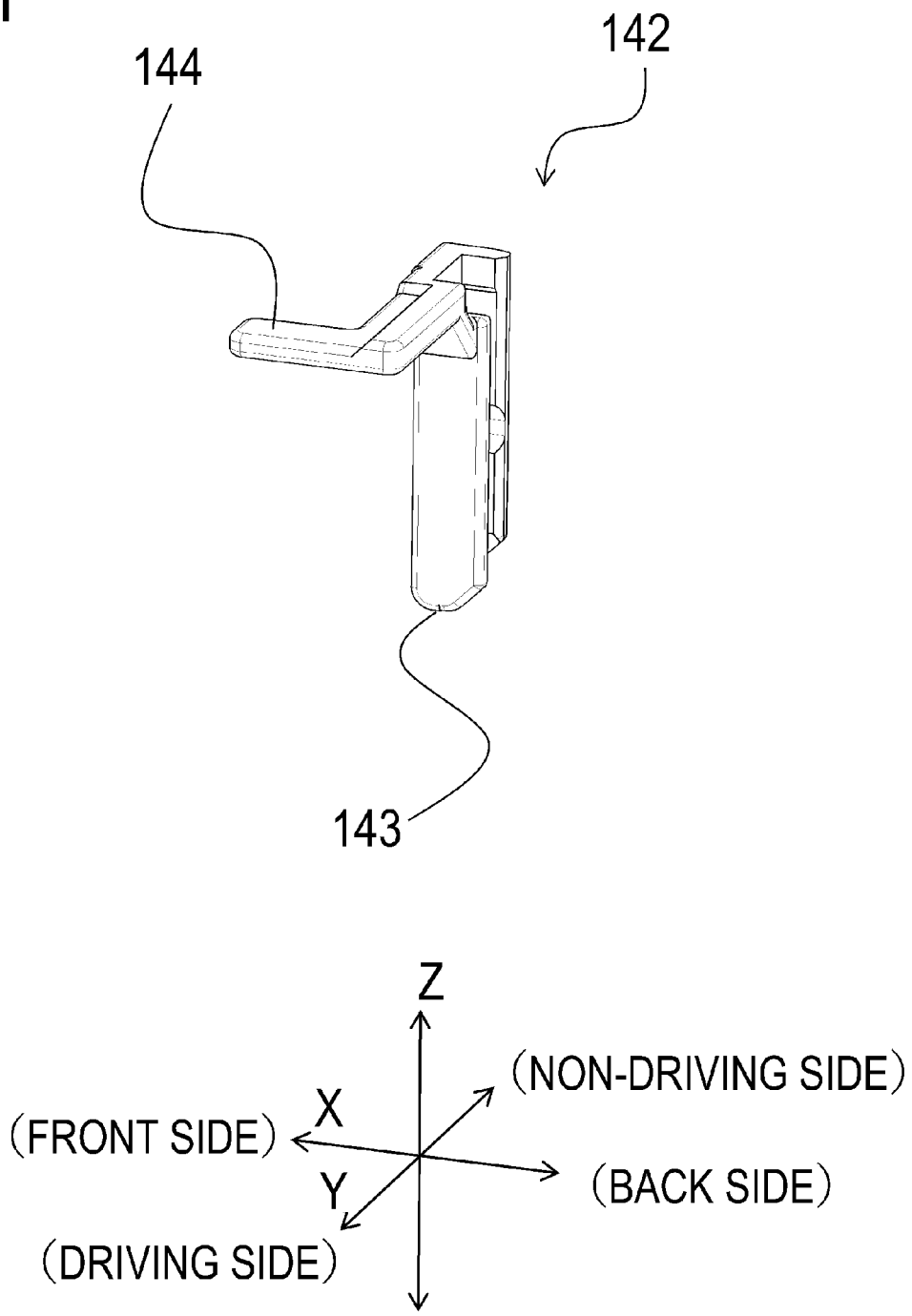
FIG. 11 is a view for illustrating a shutter link member according to the first embodiment.

With reference to FIGS. 2A, 2B, 3, 4A, 4B, 5, and 6, how to mount the cartridge will be specifically described. FIGS. 2A and 2B are views for illustrating the image forming apparatus having its opening/closing door opened, and FIG. 3 is a sectional view of the image forming apparatus having its opening/closing door opened. FIGS. 4A and 4B are views for illustrating the cartridge B. FIG. 5 is a view for illustrating the driving transmission portion and the positioning portion of the main body of the image forming apparatus. FIG. 6 is a sectional view of the image forming apparatus having its opening/closing door closed.

The state of the apparatus main body A while the opening/closing door 13 is opened will be described. As shown in FIGS. 2A, 2B, and 3, the apparatus main body A is provided with the opening/closing door 13 and an upper cover 14, and the opening/closing door 13 is provided with cartridge pressing members 1 and 2 and cartridge pressing springs 19 and 21. The opening/closing door 13 is pivotably attached to the upper cover 14. When the attachable/detachable cartridge B is mounted to the apparatus main body A, the opening/closing door 13 is pivoted upwardly with respect to the main body to open a cartridge insert opening 17 as shown in FIGS. 2A, 2B, and 3.

Now, how to mount the cartridge B will be described. As shown in FIGS. 2A and 2B, the apparatus main body A is provided with a driving side side plate 15, a non-driving side side plate 16, and a conveying guide 91. The driving side side plate 15 has a guide rail 15*g* as a guide. The non-driving side side plate 16 has an upper guide rail 16*d* and a guide rail 16*e*. The conveying guide 91 has the transfer roller 7, the conveying roller pair 5*c*, and a conveying guide (not shown) (see FIG. 3).

As shown in FIGS. 4A and 4B, the cartridge B has a rotation stopper target portion 73*c* on the driving side, and a positioning target portion 71*d*, and a rotation stopper target portion 71*g* on the non-driving side.

The cartridge B is mounted to the apparatus main body A in a direction substantially orthogonal to the axis of photosensitive drum 62. The upstream or downstream in the mounting direction refer to the upstream or downstream in the moving direction of the cartridge be immediately before the cartridge B is mounted to the apparatus main body A.

When the cartridge B is mounted from the cartridge insert opening 17 of the apparatus main body A, the rotation stopper target portion 73*c* of the cartridge B is guided to the upper guide rail 15*g* of the apparatus main body A on the driving side of the cartridge B. The positioning target portion 71*d* and the rotation stopper target portion 71*g* of the cartridge B are guided to the guide rails 16*d* and 16*e* of the apparatus main body A on the non-driving side of the cartridge B. In this way, the cartridge B is mounted to the apparatus main body A.

As shown in FIG. 5, the conveying guide 91 of the apparatus main body A has a fitting portion 101 as a positioning portion for the cartridge B in the lengthwise direction. As shown in FIGS. 4A and 4B, a fitting target portion 121 as a portion to be positioned which can be fitted with the fitting portion 101 of the apparatus main body A is provided on the driving side of the cartridge B. In the mounting process, the fitting target portion 121 of the cartridge B is fitted with the fitting portion 101 of the apparatus main body A (as the recessed fitting target portion 121 is fitted with the raised fitting portion 101 in the direction orthogonal to the lengthwise direction (the axial direction) of the cartridge B), so that the cartridge B is positioned in the lengthwise direction (the axial direction).

Now, the state in which the opening/closing door 13 is closed will be described. As shown in FIGS. 2A, 2B, 3, and 5, the conveying guide 91 of the apparatus main body A has an upper positioning portion 91*a* and a lower positioning portion 91*b* as positioning portions on the driving side and a positioning portion 91*c* on the non-driving side. The driving side side plate 15 of the apparatus main body A has a rotation stopper portion 15*c* (provided at the terminal end of the upper guide rail 15*g* in the mounting direction, see FIG. 6) and the non-driving side side plate 16 has a rotation stopper portion 16*c*. As shown in FIG. 4A, the cartridge B has an upper positioning target portion 73*d* and a lower positioning target portion 73*f* on the driving side.

The cartridge pressing members 1 and 2 are provided at opposed ends of the opening/closing door 13 in the lengthwise direction. The cartridge pressing springs 19 and 21 are attached to the cartridge pressing members 1 and 2. The cartridge B has a pressing target portion 73*e* as a biasing force receiving portion on the driving side and a pressing target portion 710 on the non-driving side. As the opening/closing door 13 is closed, the pressing target portions 73*e* and 710 of the cartridge B are pressed by the cartridge pressing members 1 and 2 biased by the cartridge pressing springs 19 and 21 of the apparatus main body A (see FIG. 6).

In this way, on the driving side, the upper positioning target portion 73*d*, the lower positioning target portion 73*f*, and the rotation stopper target portion 73*c* of the cartridge B abut against the upper positioning portion 91*a*, the lower positioning portion 91*b*, and rotation stopper portion 15*c* of the apparatus main body A, respectively. As a result, the cartridge B and the photosensitive drum 62 are positioned on the driving side. On the non-driving side, the positioning target portion 71*d* and the rotation stopper target portion 71*g* of the cartridge B abut against the positioning portion 91*c* and the rotation stopper portion 16*c* of the apparatus main body A, respectively. In this way, the cartridge B and the photosensitive drum 62 are positioned on the non-driving side. Hereinafter, this state in which the cartridge B is positioned with respect to the apparatus main body A in the mounting direction is defined as a state in which the cartridge B is mounted in the mounting portion of the apparatus main body A.

Figure 12:
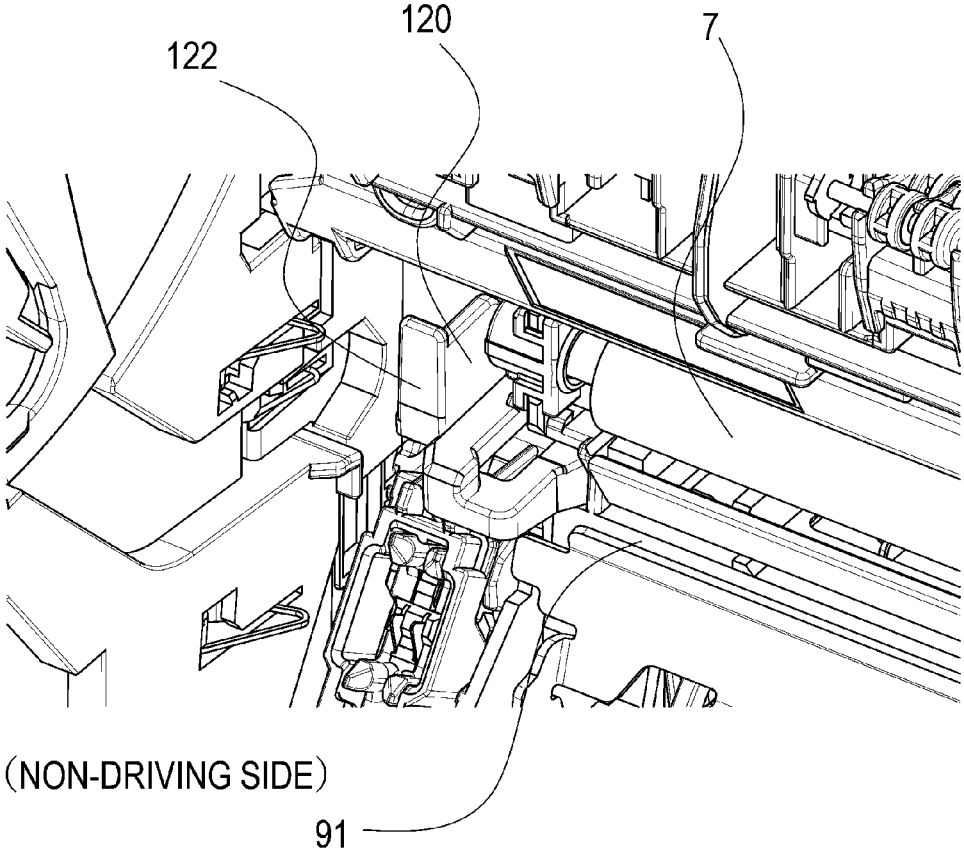
FIG. 12 is a view for illustrating the arrangement of an interface member in the main body according to the first embodiment.
Figure 13A:
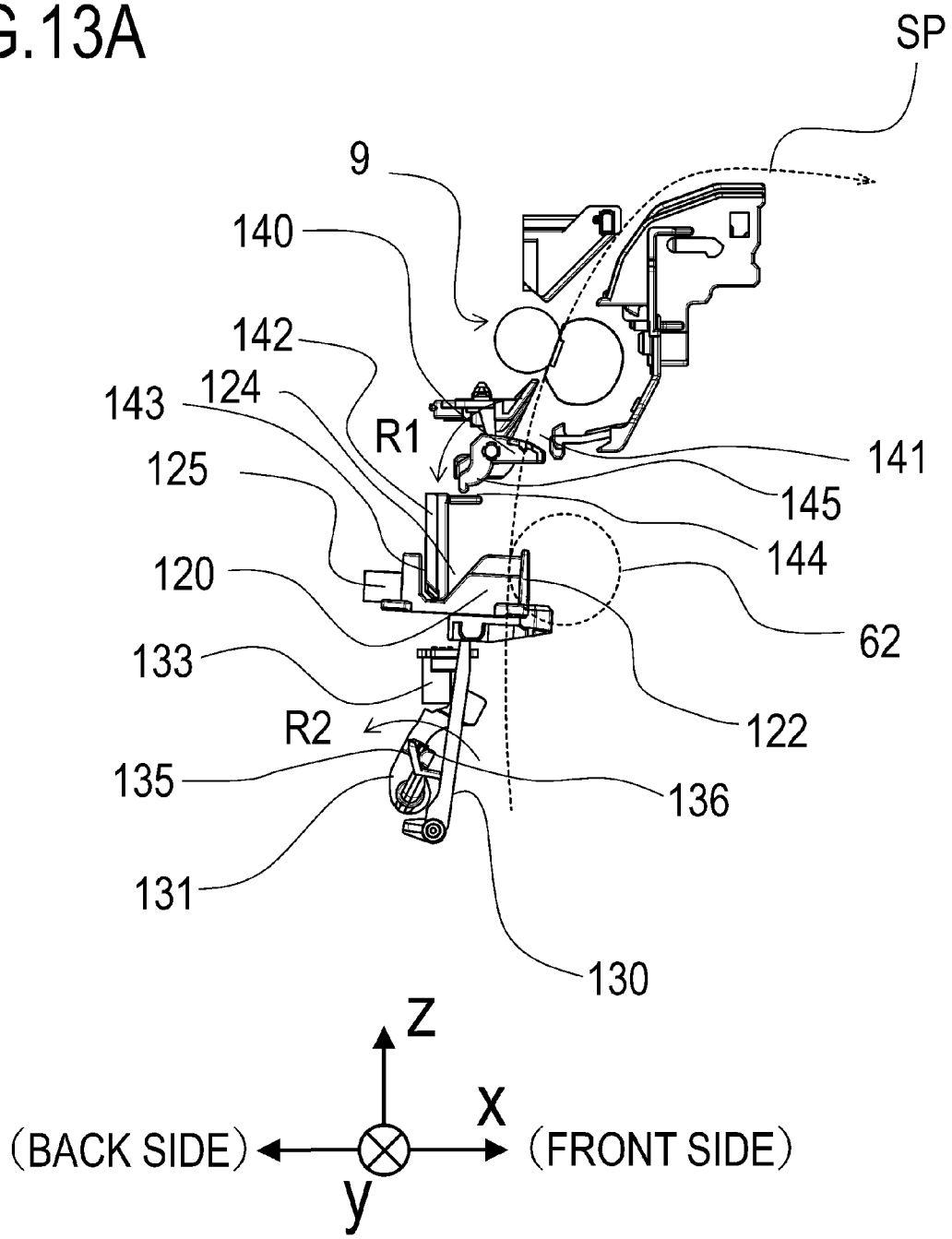
FIG. 13A is a view for illustrating the state in which the cartridge according to the first embodiment is not inserted.
Figure 13B:
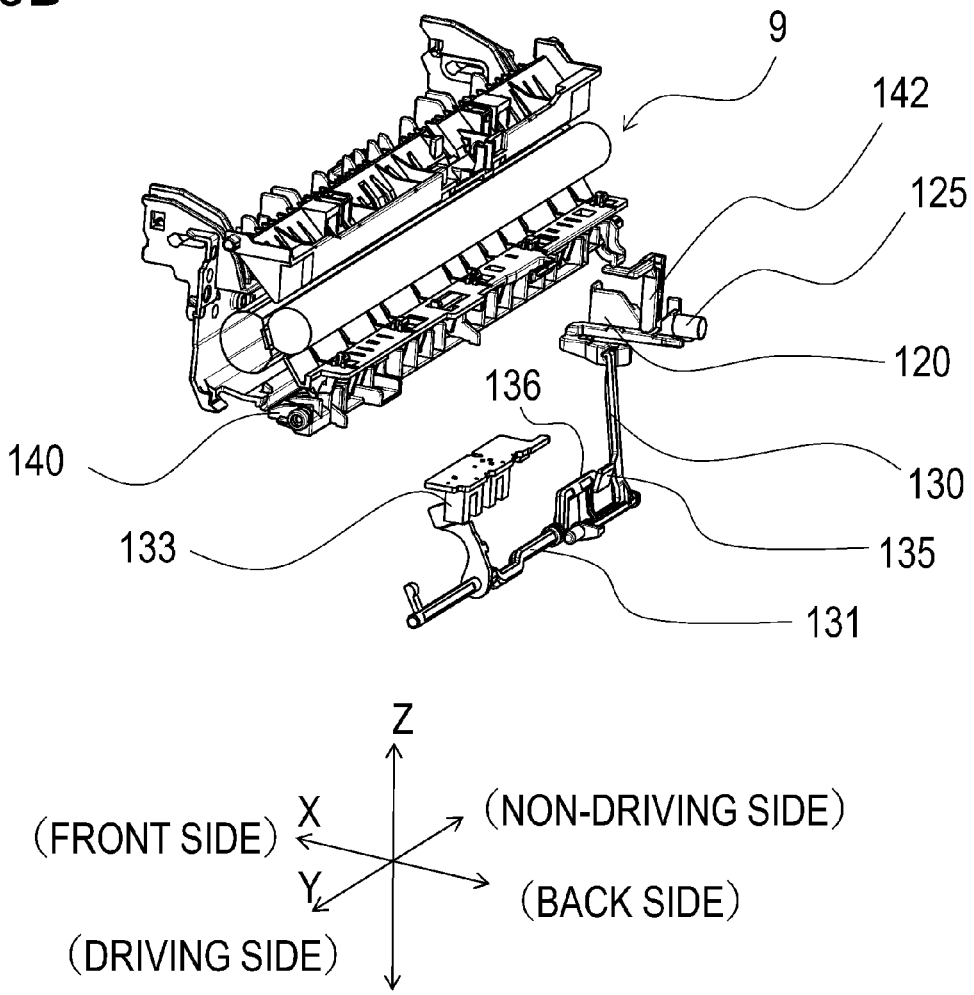
FIG. 13B is a view for illustrating the state in which the cartridge according to the first embodiment is not inserted.

Configuration of Cartridge Presence/Absence Detecting Mechanism and Fixing Entrance Shutter Mechanism With reference to FIGS. 4A, 4B, 7 to 13A and 13B, the configurations of the cartridge presence/absence detecting mechanism and the fixing entrance shutter mechanism will be described. FIGS. 7 to 11 are views each showing a single component according to the embodiment. FIG. 12 is an enlarged view of the inside in FIG. 2B showing the arrangement of an interface member 120 in the apparatus main body A. FIGS. 13A and 13B show the state in which the cartridge B is not inserted, FIG. 13A is a view from the left side (the non-driving side) of the apparatus main body A, and FIG. 13B is a view from diagonally right behind the apparatus main body A (the driving side and the back side). In order to make the part related to the embodiment visible, FIGS. 13A and 13B do not show components which are not related to the present invention, such as the conveying guide 91 and the mechanism for detecting the paper width (hereinafter referred to as the paper width detecting mechanism).

The cartridge B in the embodiment has a cartridge-side protruding portion 102 on the non-driving side which protrudes in the inserting direction of the cartridge B beyond the photosensitive drum 62. That is, the cartridge-side protruding portion 102 is positioned at the downstream side from the photosensitive drum 62 in the mounting direction. Further, the cartridge-side protruding portion 102 is positioned at the end in the direction of the rotation axis of the photosensitive drum 62.

In the embodiment, the cartridge-side protruding portion 102 also serves as a protective member (an abutting portion) which prevents the photosensitive drum 62 from contacting a floor surface and getting stains and scratches when the cartridge B taken out from the main body A is placed on the floor and comes into abutment against the floor surface.

The conveying guide 91 of the apparatus main body A has the interface member 120 (moving member) which can move substantially linearly (linearly move) with respect to the direction in which the cartridge B is inserted. The interface member 120 has a main body side abutting portion 122 (abutted portion) to be abutted against the cartridge-side protruding portion 102 (abutting portion) (FIGS. 4B and 12). The interface member 120 is a common interface member for the cartridge presence/absence detecting mechanism and the fixing entrance shutter mechanism. In other words, the component which triggers operation in conjunction with the cartridge presence/absence detecting mechanism and the fixing entrance shutter mechanism is shared by these mechanisms as a single component. More specifically, the plurality of mechanisms are operated in a manner in conjunction with each other by the operation of the single interface member.

The conveying guide 91 has a cartridge presence/absence detecting lever 130 (link member) which can be rotated and a sensor link member 131 (acting member) operated in conjunction with the cartridge presence/absence detecting lever 130. The sensor link member 131 has a light-shielding portion 132 (acting portion) as a light-shielding member. The sensor link member 131 has a photo-interrupter 133 as an optical sensor which allows detection light from the light-emitting portion to the light-receiving portion to be switched between a transmission state and a light-shielding state in response to change in the position of the light-shielding portion 132 caused by change in the position of the sensor link member 131. This part is referred to as the cartridge presence/absence detecting mechanism. The light-emitting portion is a portion that emits light, and the light-receiving portion is a portion that is configured to receive the light emitted from the light-emitting portion. The sensor link member 131 is configured to be movable between a first position in which the photo-interrupter 133 is made the transmission state and a second position in which the photo-interrupter 133 is made the light-shielding state by the light-shielding portion 132. The cartridge presence/absence detecting mechanism has the photo-interrupter 133 (sensor) and the sensor link member 131 provided with the light-shielding portion 132 that acts on the photo-interrupter 133. The cartridge presence/absence detecting lever 130 and the sensor link member 131 may be integrally configured.

The cartridge presence/absence detecting mechanism in the embodiment also has the function of detecting whether the width of the conveyed sheet PA is larger or smaller than a prescribed size. In other words, the sensor link member 131 is operated in conjunction with the paper width detecting mechanism, which is not shown in FIGS. 13A and 13B. As will be described in detail, an optical detecting unit including the light-shielding portion 132 and the photo-interrupter 133 described above is a common optical detecting unit used for the cartridge presence/absence detecting mechanism and the paper width detecting mechanism which will be described. More specifically, the image forming apparatus according to the embodiment is configured to achieve detection operation by the multiple detecting mechanisms using the single optical detecting unit.

The conveying guide 91 has a fixing entrance shutter 140 which opens and closes the fixing entrance portion 141 as the entrance to the fixing apparatus 9 in the recording material conveyance path and a shutter link member 142 at the fixing entrance portion 141 through which the sheet PA is conveyed to the fixing apparatus 9. The fixing entrance shutter 140 is provided pivotably around the y-axis about a shutter pivot center 146 extending in the y-axis direction. The shutter link member 142 opens/closes the fixing entrance shutter 140 in conjunction with the interface member 120. The shutter link member 142 can move linearly only in the vertical direction (the z-axis direction) in FIG. 13A. These elements are referred to as the fixing entrance shutter mechanism. The fixing entrance shutter 140 moves between a closed position in which the fixing entrance portion 141 is closed and an open position in which the fixing entrance portion 141 is opened.

The interface member 120 has an engagement groove 123 (engaged portion) for operating in conjunction with the cartridge presence/absence detecting lever 130, and is connected to the cartridge presence/absence detecting lever 130 as the engagement boss 134 (engaging portion) of the cartridge presence/absence detecting lever 130 is engaged with the engagement groove 123. The interface member 120 has a sliding surface 124 (inclined surface) including a slope portion for operating in conjunction with the shutter link member 142. The shutter link member 142 has a sliding surface abutting portion 143 which abut against the sliding surface 124. The sliding surface 124 is an inclined surface that extends downward toward the mounting direction of the cartridge B The interface member 120 is constantly pressed in the direction opposite to the direction in which the cartridge B is inserted by biasing member 125 such as a spring. The fixing entrance shutter 140 is constantly biased in the direction of the arrow R1 by a biasing member which is not shown.

Interlocking Operation Between Cartridge Presence/Absence Detecting Mechanism and Fixing Entrance Shutter Mechanism With reference to FIGS. 4A, 4B, 13A, 13B, 14A, and 14B, the operation in conjunction with the cartridge presence/absence detecting mechanism and the fixing entrance shutter mechanism will be described in detail.

With reference to FIGS. 13A and 13B, the state in which the cartridge B is not inserted in the apparatus main body A (the state in which the cartridge is not mounted on the mounting portion) will be described.

The cartridge presence/absence detecting mechanism will be described. The interface member 120 is biased in the direction opposite to the direction in which the cartridge B is inserted by the biasing member 125, and the main body side abutting portion 122 is positioned to protrude into the mounting space for the cartridge B. At the time, the position of the cartridge presence/absence detecting lever 130 is uniquely determined by engagement between the engagement groove 123 with the engagement boss 134. The cartridge presence/absence detecting lever 130 has a lever-side abutting portion 135, and the sensor link member 131 has a sensor link-side abutting portion 136. The sensor link member 131 is biased in the direction of the arrow R2 around the y-axis by a biasing member which is not shown. Here, the biasing force by the biasing member, which is not shown, for biasing the sensor link member 131 is smaller than the biasing force by the biasing member 125 for biasing the interface member 120. Therefore, the sensor link-side abutting portion 136 is in abutment against the lever-side abutting portion 135, the position of which is uniquely determined, so that the sensor link-side abutting portion 136 follows the lever-side abutting portion 135. In this way, the sensor link member 131 operates in a manner in conjunction with the cartridge presence/absence detecting lever 130, and the position of the sensor link member 131 is determined as the position of the cartridge presence/absence detecting lever 130 is determined.

As mentioned above, the sensor link member 131 has the light-shielding portion 132 for switching between transmission and shielding through the optical axis (not shown) of the photo-interrupter 133. According to the embodiment, in the state shown in FIGS. 13A and 13B, in which the cartridge B is not inserted, the light-shielding portion 132 is in a position where the optical axis attains a transmission state. That is, in the state in which the cartridge B is not inserted in the apparatus main body A (the state in which the cartridge is not mounted on the mounting portion), the sensor link member 131 is positioned in the first position.

Now, the fixing entrance shutter mechanism will be described. In the state in FIGS. 13A and 13B, the sliding surface abutting portion 143 of the shutter link member 142 is positioned on the lower side of the slope in the sliding surface 124 of the interface member 120. The shutter link member 142 (intermediate member) has a shutter push-up portion 144 on the opposite side to the sliding surface abutting portion 143 (on the upper side in FIGS. 13A and 13B). The fixing entrance shutter 140 has a shutter side abutting portion 145 in a position where the shutter abuts against the shutter push-up portion 144. In other words, the fixing entrance shutter 140 is a rotating member provided with the shutter side abutting portion 145 as an integral part thereof to which rotation force is applied from the shutter link member 142. The fixing entrance shutter 140 according to the embodiment can pivot around the shutter pivot center 146 and is constantly biased in the direction of the arrow R1 by the biasing member (not shown) as described above. More specifically, the shutter push-up portion 144 and the shutter side abutting portion 145 are in abutment against each other. The dashed arrow SP indicates a sheet conveyance path (a recording material conveyance path). In other words, when the cartridge B is not inserted, the fixing entrance shutter 140 is in the position to block the conveyance path.

Figure 14A:
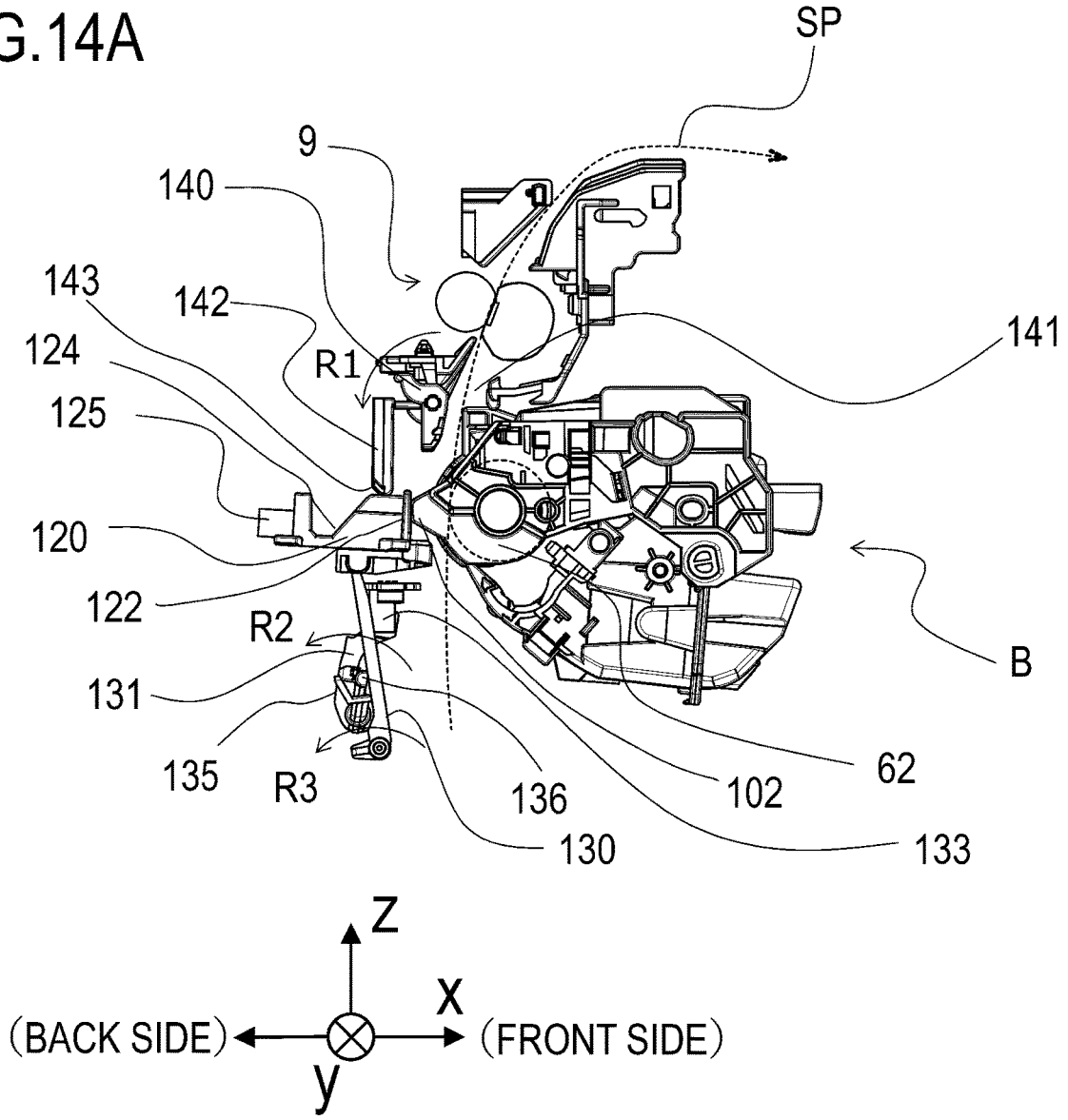
FIG. 14A is a view for illustrating the state in which the cartridge according to the first embodiment is inserted.
Figure 14B:
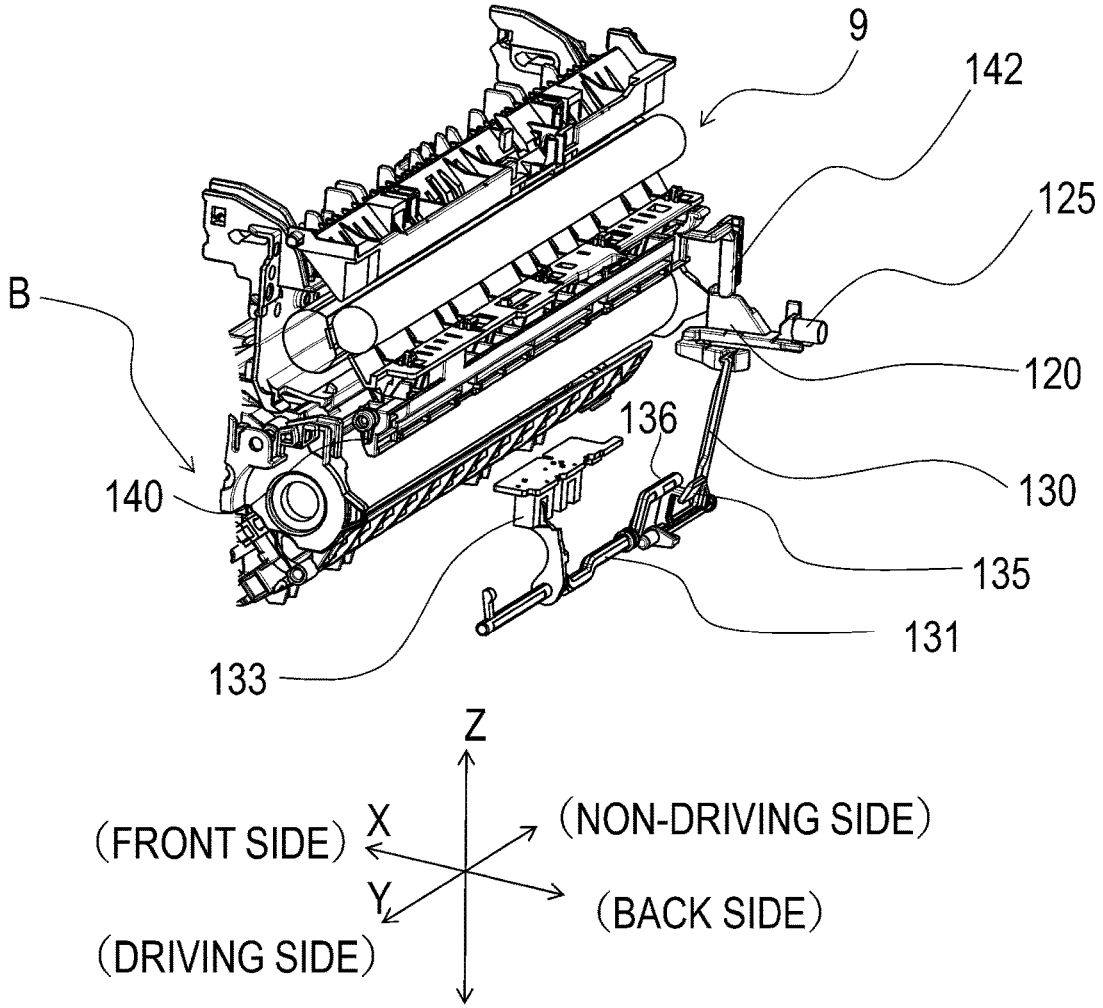
FIG. 14B is a view for illustrating the state in which the cartridge according to the first embodiment is inserted.

Next, the state in which the cartridge B is inserted in the apparatus main body A (the state in which the cartridge is mounted in the mounting portion) will be described with reference to FIGS. 4A, 4B, 14A, 14B, 15A, 15B, and 15C. FIG. 14A is a view from the left side (the non-driving side) of the apparatus main body A. FIG. 14B is a view from diagonally right behind the apparatus main body A (the driving side and the back side). In order to make the part related to the present invention visible, FIGS. 14A and 14B do not show components which are not related to the embodiment, such as the conveying guide 91 and the mechanism for detecting the paper width.

The cartridge presence/absence detecting mechanism will be described. When the cartridge B is inserted in the apparatus main body A, the position of the cartridge-side protrusion 102 is uniquely determined by the positioning portions, the rotation stopper portions, the pressing portions (71*d*, 71*g*, 71*o*, 73*c*, 73*d*, 73*f*, and 73*e*), and the pressing members (1 and 2) as described above. Therefore, the cartridge-side protrusion 102 pushes in the main body side abutting portion 122, and the interface member 120 moves in the inserting direction of the cartridge B.

As described above, the interface member 120 and the cartridge presence/absence detecting lever 130 are connected by engagement between the engagement boss 134 of the cartridge presence/absence detecting lever 130 and the engagement groove 123 of the interface member 120. The interface member 120 moves substantially linearly (linearly move), while the cartridge presence/absence detecting lever 130 pivots (rotational move). In order to operate in conjunction with these two components, the engagement groove 123 according to the embodiment has a gap substantially orthogonal to the direction in which the cartridge B is inserted (the mounting direction). In other words, when the cartridge presence/absence detecting lever 130 pivots, the engagement boss 134 is displaced in the vertical direction as shown in FIGS. 14A and 14B, but the engagement groove 123 has the gap in the vertical direction, so that the displacement does not prevent the engagement (the engaged state can be maintained).

As the engagement allows the interface member 120 to move in the direction in which the cartridge B is inserted, the cartridge presence/absence detecting lever 130 pivots around the lever pivot center 137 in the direction of the arrow R3. Accordingly, the lever-side abutting portion 135 also pivots in the direction of the arrow R3. Here, the sensor link member 131 is biased in the direction of the arrow R2 by the biasing member which is not shown. More specifically, the sensor link member 131 pivots in the direction of the arrow R2 while the lever-side abutting portion 135 and the sensor link-side abutting portion 136 are kept in abutment. Accordingly, the light-shielding portion 132 also pivots, so that light is shielded with respect to the optical axis (not shown) of the photo-interrupter 133 in the embodiment. That is, in the state in which the cartridge B is inserted in the apparatus main body A (the state in which the cartridge is mounted in the mounting portion), the sensor link member 131 is positioned in the second position.

Here, the sensor link member 131 in the embodiment is operated in conjunction with the paper width detecting mechanism (not shown) as described above. The sensor link member 131 pivots by a certain amount in the direction of the arrow R2 and then abuts against the paper width detecting mechanism (not shown) to stop pivoting. At the time, the sensor link member 131 keeps the light-shielding portion 132 to block light with respect to the optical axis (not shown) of the photo-interrupter 133. According to the embodiment, when the cartridge B is completely inserted, the cartridge presence/absence detecting lever 130 is in a further pivoted position, so that the lever-side abutting portion 135 is in a position away from the sensor link-side abutting portion 136 as shown in FIGS. 4A and 4B.

Figure 15A:
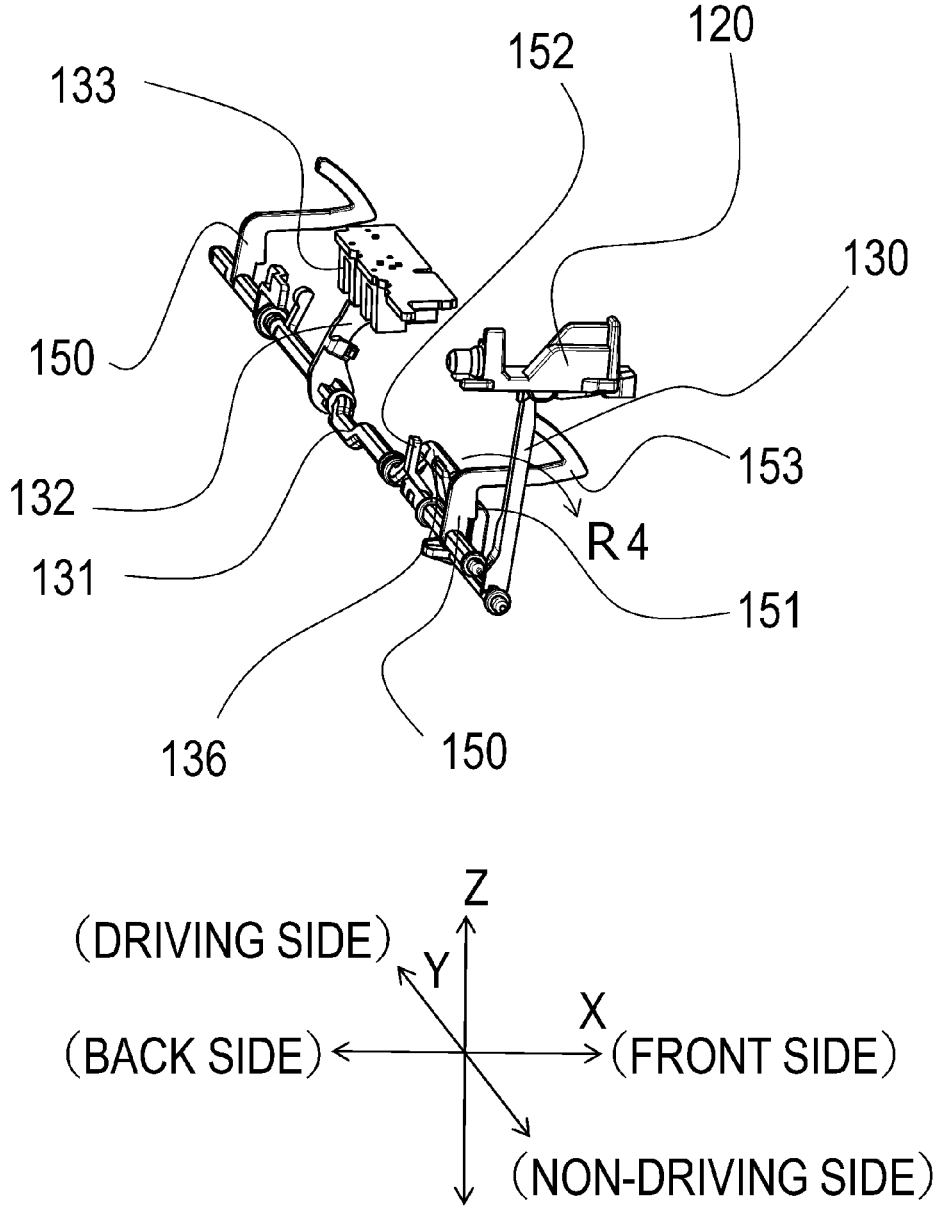
FIG. 15A is a view for illustrating a cartridge presence/absence detecting mechanism and a paper width detecting mechanism according to the first embodiment.
Figure 15B:
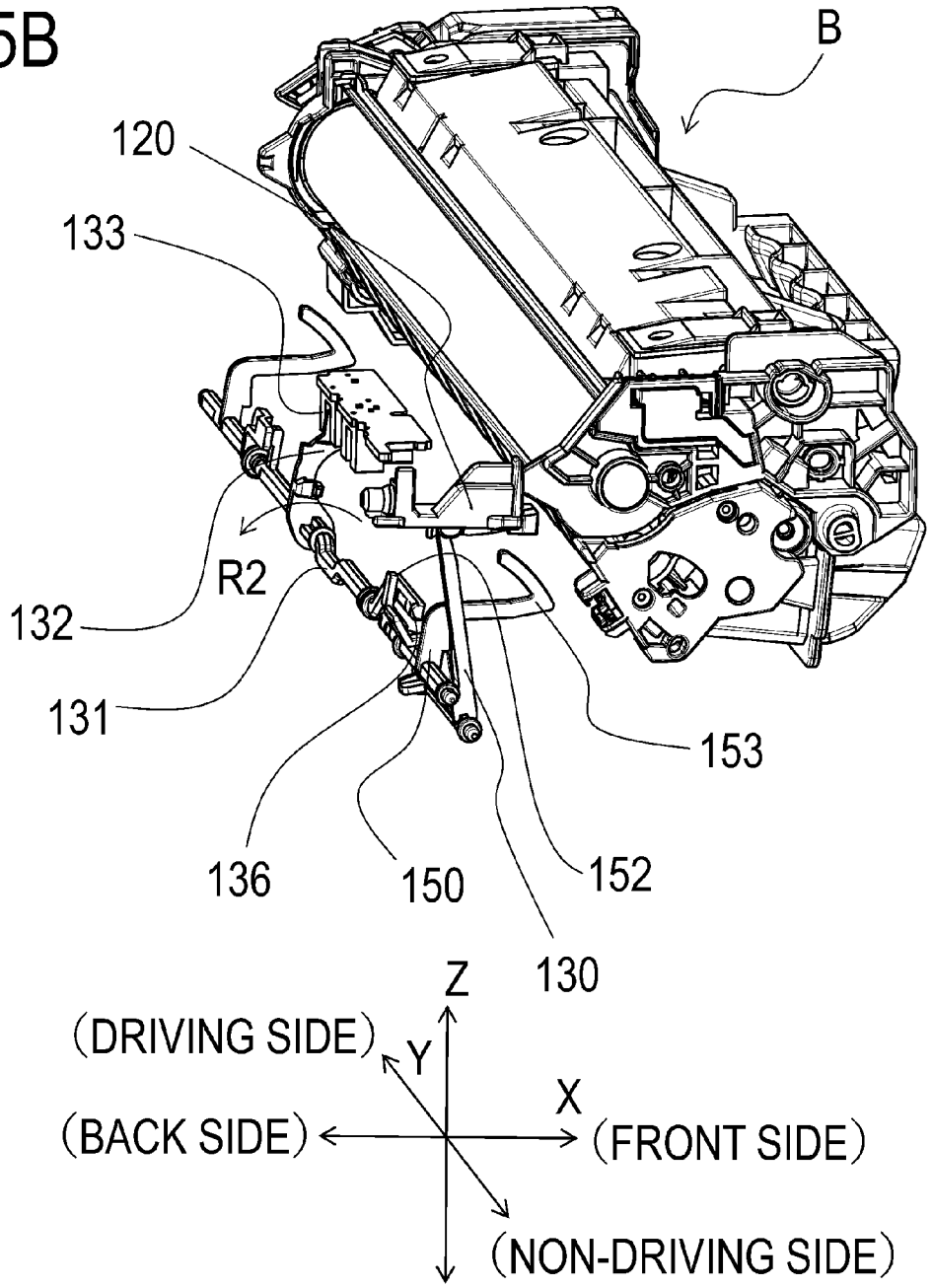
FIG. 15B is a view for illustrating the cartridge presence/absence detecting mechanism and the paper width detecting mechanism according to the first embodiment.
Figure 15C:
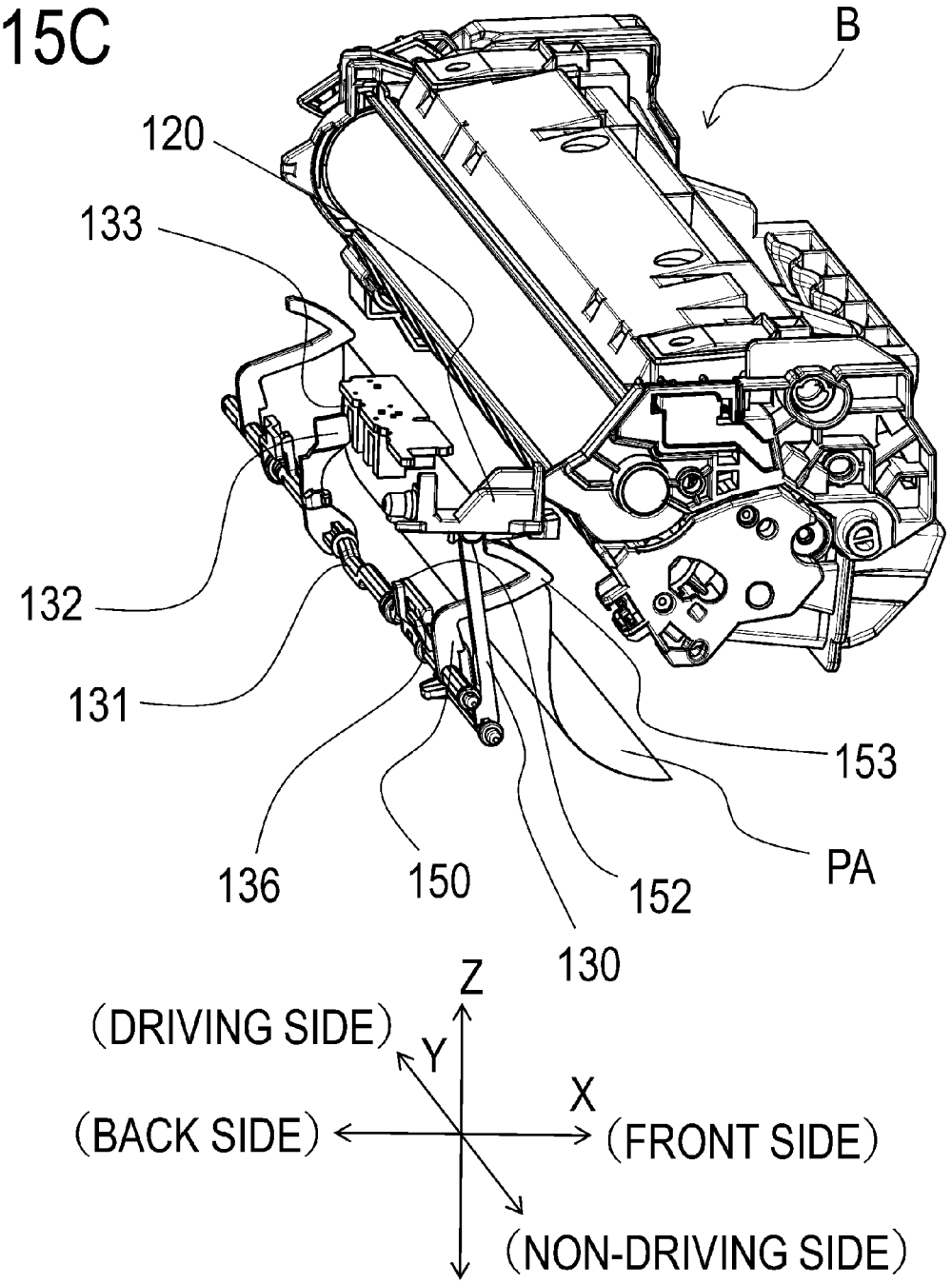
FIG. 15C is a view for illustrating the cartridge presence/absence detecting mechanism and the paper width detecting mechanism according to the first embodiment.

Here, with reference to FIGS. 15A, 15B, and 15C, the operation in conjunction with the paper width detecting mechanism as a second detecting mechanism will be described. FIGS. 15A, 15B and 15C show the apparatus main body A viewed from diagonally left behind the apparatus main body A (the non-driving side and the back side). FIG. 15A shows the state in which the cartridge B is not inserted, FIG. 15B shows the state in which the cartridge B is inserted, and FIG. 15C shows the state in which the sheet PA reaches the paper width detecting mechanism from the state in FIG. 15B and the sheet PA width is detected. The conveying guide 91 is not shown for the sake of description.

With reference to FIG. 15A, the state before the cartridge B is inserted will be described. According to the embodiment, the paper width detecting levers 150 (contact member) not shown in FIGS. 13A, 13B, 14A, and 14B) are arranged in a pair on the left and right in a direction orthogonal to the sheet PA conveying direction, and are each biased in the direction of the arrow R4 around the y-axis by the biasing member (not shown) each having equal biasing force. According to the embodiment, since the operation is the same for the left and right sides, only one of these elements will be described. The abutting portion (not shown) of the conveying guide 91 and the abutting portion 151 of the paper width detecting lever 150 come into abutment and stop. At the time, in the embodiment, there is a gap between the sensor link-side abutting portion 136 of the sensor link member 131 and the paper width detecting lever-side abutting portion 152. The light-shielding portion 132 of the sensor link member 131 is in a position where the optical axis (not shown) of the photo-interrupter 133 attains a transmission state.

FIG. 15B illustrates the state in which the cartridge B is inserted. When the cartridge B is inserted as described above, the sensor link member 131 rotates in the direction of the arrow R2. Here, the biasing force from the biasing member for biasing the sensor link member 131 is set to be smaller than the total of the biasing force from the biasing member (not shown) for biasing the paper width detecting lever 150. More specifically, the sensor link member 131, which pivots in a manner in conjunction with the cartridge presence/absence detecting lever 130, stops when the sensor link-side abutting portion 136 and the paper width detecting lever-side abutting portion 152 come into abutment. Therefore, there is a gap between the lever-side abutting portion 135 and the sensor link-side abutting portion 136. At the time, the light-shielding portion 132 of the sensor link member 131 is in a position where the optical axis (not shown) of the photo-interrupter 133 attains a light-shielding state. A paper width detecting portion 153 as a contact member is in a position protruding into the sheet PA conveyance path side.

In FIG. 15C, the state in which the width of the conveyed sheet PA is detected to be larger than a prescribed size (predetermined width) (the operation of a second interlocking mechanism) will be described. When the tip end of the sheet PA contacts the paper width detecting portion 153, the paper width detecting portion 153 (contact portion) is pushed by the sheet PA, and the paper width detecting lever 150 pivots. The rotation of the paper width detecting lever 150 causes the paper width detecting lever-side abutting portion 152 to pivot. Here, since the sensor link member 131 is biased in the direction of the arrow R2 by the biasing member which is not shown, the paper width detecting lever-side abutting portion 152 and the sensor link-side abutting portion 136 are kept in abutment state. This causes the sensor link member 131 to pivot, and when the rotation of the paper width detecting lever 150 by the sheet PA exceeds a certain amount, the light-shielding portion 132 of the sensor link member 131 comes in a position (third position) where the optical axis (not shown) attains a transmission state. In this way, it can be determined that the sheet PA is larger than the prescribed size. That is, the sensor link member 131 is configured to move from the second position to the third position when the sensor link member 131 is pushed by the recording material whose width in the conveying direction of the recording material is equal to or larger than a predetermined width.

Thereafter, when the rear end of the sheet PA exits the paper width detecting portion 153, the paper width detecting lever 150 returns to the state in FIG. 15B. When the sheet PA is smaller than the prescribed size (when width is narrower than the predetermined width), the paper width detecting portion 153 and the sheet PA do not come into abutment against each other. Therefore, the paper width detecting lever 150 does not pivot, and the optical axis of the photo-interrupter 133 (not shown) is kept in the light-shielding state. That is, the sensor link member 131 is kept in the second position.

On the basis of the size detection result about the sheet PA from the paper width detecting mechanism described above, an engine controller (not shown) carries out such a control that the fixing temperature control is lowered when it is determined that the sheet size is smaller than the prescribed size.

According to the embodiment, the rotation phase in which the light-shielding portion 132 causes the photo-interrupter 133 to attain the transmission state in the cartridge presence/absence detecting mechanism is different from the rotation phase in which the light-shielding portion 132 causes the photo-interrupter 133 to attain the transmission state in the paper width detecting mechanism. More specifically, in the cartridge presence/absence detecting mechanism, when the photo-interrupter 133 changes from the light-shielding state to the transmission state (when the cartridge B is removed), the direction of rotation of the light-shielding portion 132 is one rotation direction. In the paper width detecting mechanism, when the photo-interrupter 133 changes from the light-shielding state to the transmission state (when the passage of a recording material is detected), the direction of rotation of the light-shielding portion 132 is the other direction, which is the opposite of the above-mentioned direction. From a different point of view, in the flow of events from mounting of the cartridge B in the apparatus main body A to detection of the width for conveying the recording material, the direction in which the light-shielding portion 132 rotates with respect to the photo-interrupter 133 is one direction (the other rotation direction). Similarly, the direction in which the light-shielding portion 132 rotates with respect to the photo-interrupter 133 is one direction (one rotation direction) in the flow of events until when the passage of the recording material is no longer detected and the cartridge B is removed from the apparatus main body A.

Next, the fixing entrance shutter mechanism will be described. As described above, the interface member 120 has a sliding surface 124 including a slope. In other words, when the interface member 120 moves in the insertion direction of the cartridge B, the sliding surface 124 also moves in the insertion direction of the cartridge B. The sliding surface abutting portion 143 of the shutter link member 142 is constantly in abutment against the sliding surface 124 and can move linearly only in the vertical direction (the z-axis direction) in FIG. 14A, and therefore the sliding surface abutting portion 143 moves upward as the sliding surface 124 moves. In other words, the slope of the sliding surface 124 functions as a cam surface. As a result, the shutter push-up portion 144 also moves upward. That is, a rotation direction of the sensor link member 131 from the second position to the third position is opposite to a rotation direction of the link sensor member 131 from the second position to the first position.

Figure 16A:
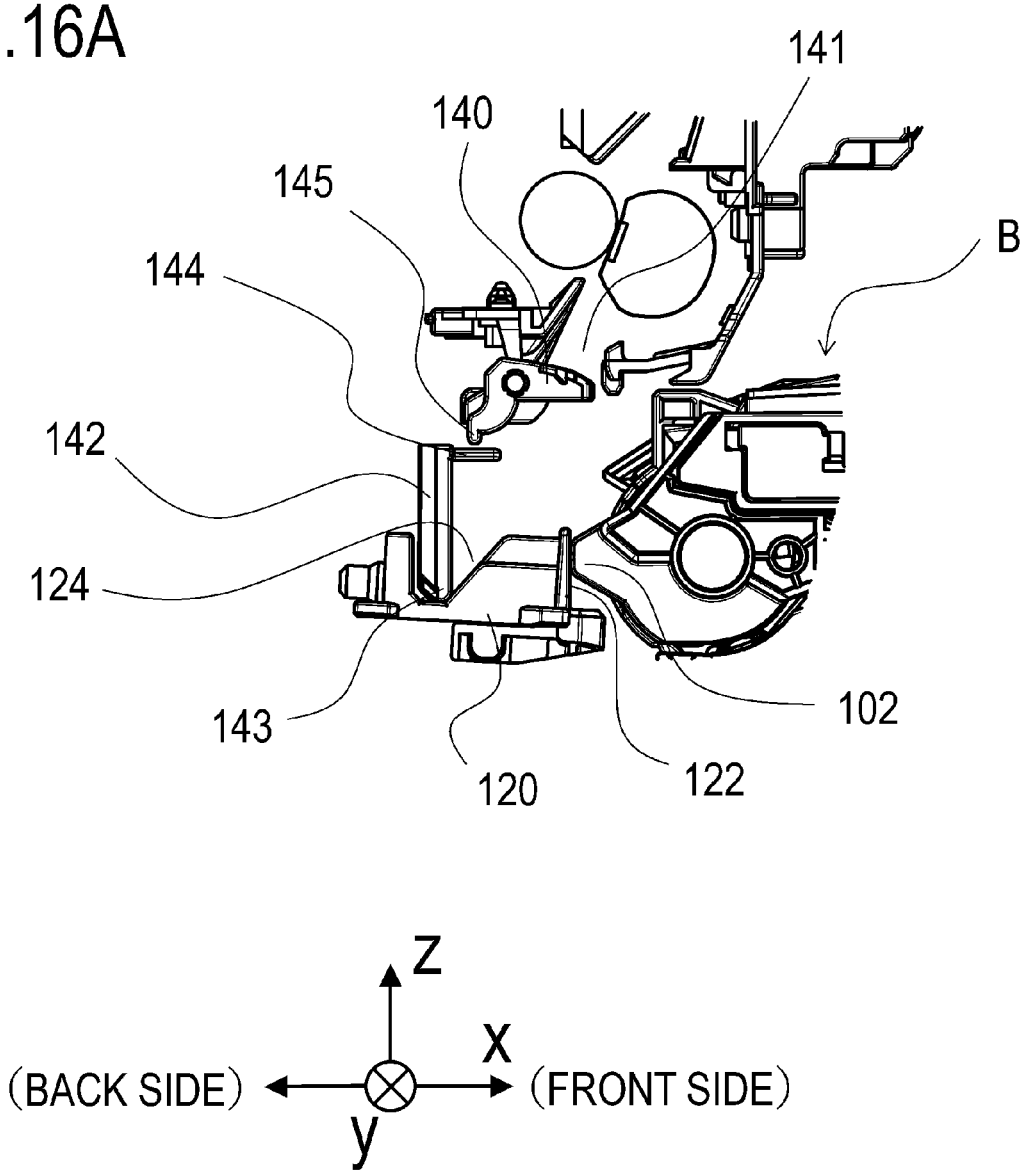
FIG. 16A is a view for illustrating the operation of a fixing entrance shutter according to the first embodiment.
Figure 16B:
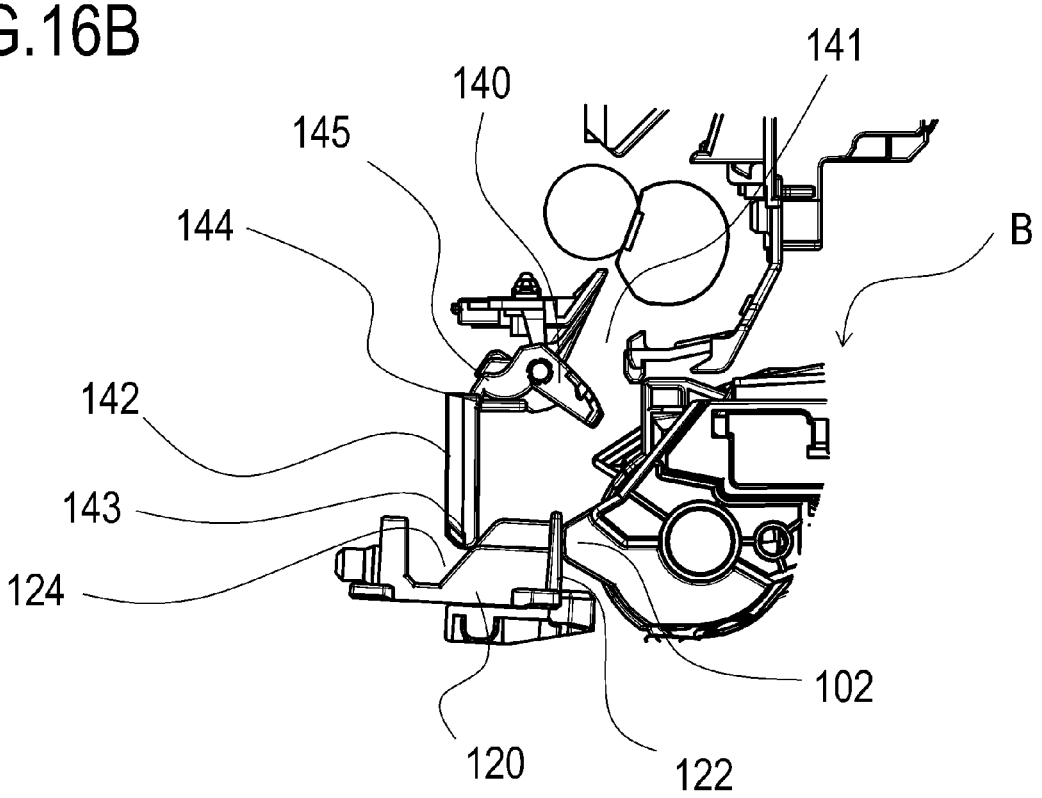
FIG. 16B is a view for illustrating the operation of a fixing entrance shutter according to the first embodiment.
Figure 16B:
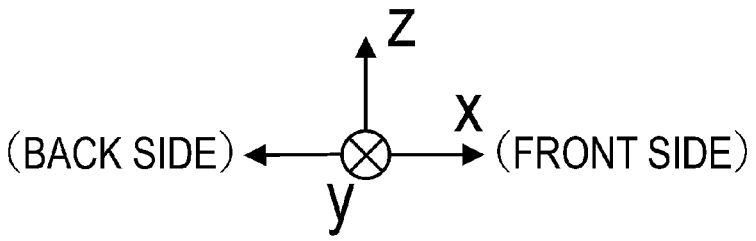
Figure 16C:
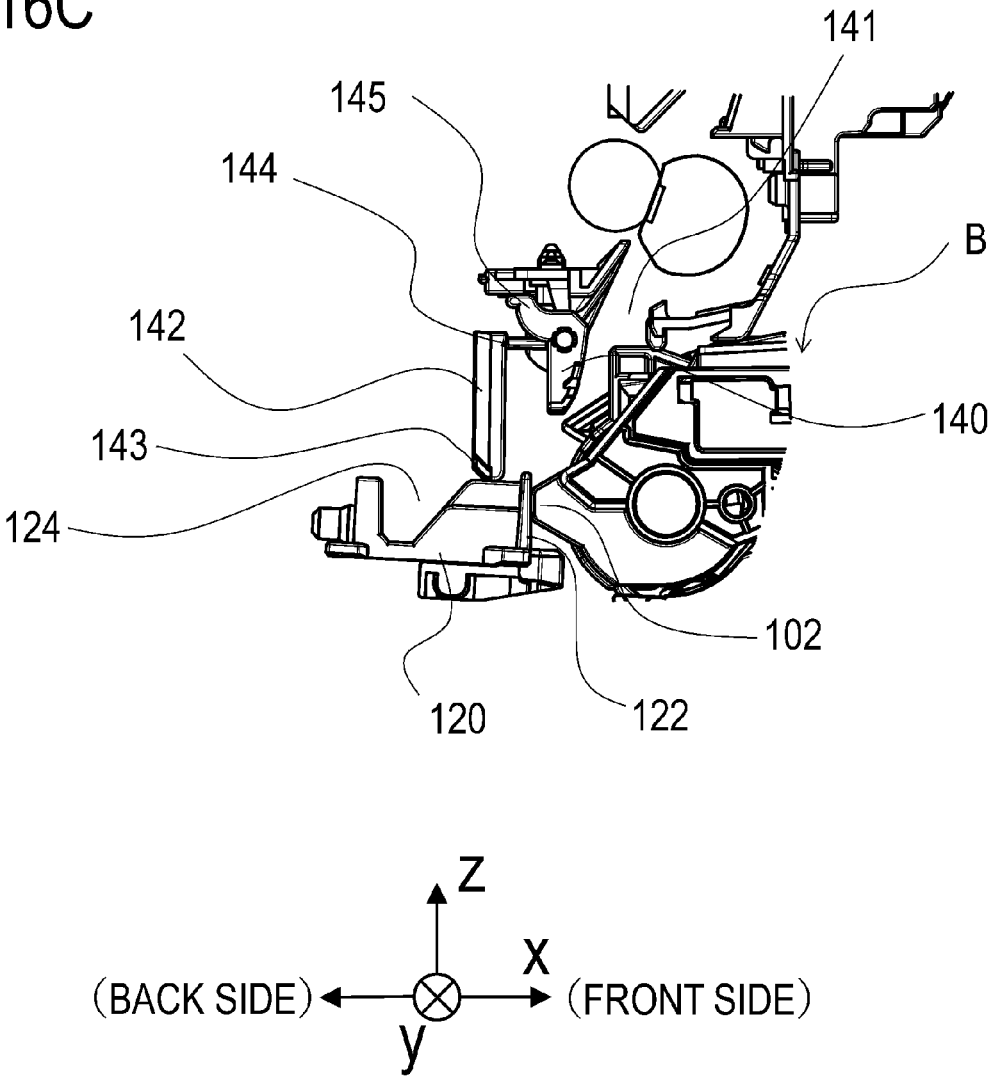
FIG. 16C is a view for illustrating the operation of a fixing entrance shutter according to the first embodiment.

Here, the operation of the interface member 120, the shutter link member 142, and the fixing entrance shutter when the cartridge B is inserted in the embodiment is shown in FIGS. 16A, 16B, and 16C. FIGS. 16A, 16B and 16C are views of the apparatus main body A from the left side (the non-driving side), and parts irrelevant to the present invention, such as the conveying guide 91 are not shown in order to make the parts related to the present invention visible.

FIG. 16A shows the state at the moment the cartridge-side protruding portion 102 of the cartridge B and the main body side abutting portion 122 come into contact (abutment). As the cartridge B is inserted, the interface member 120 moves in the direction in which the cartridge B is inserted. FIG. 16B shows the state at the moment the insertion of the cartridge B is further advanced. In the embodiment, as shown in FIG. 16B, the contact between the shutter push-up portion 144 and the shutter side abutting portion 145 is switched from the tip end to the base portion during the movement of the interface member 120. In other words, the fixing entrance shutter 140 is configured so that the distance from the center of the rotation axis to the shutter side abutting portion 145 as the abutted portion against which the shutter push-up portion 144 abuts changes with rotation and is reduced with rotation during the movement from the closed state to the open state. This is for the purpose of further reducing the size of the apparatus main body A by reducing the moving amount of the interface member 120 and the moving amount of the shutter link member 142. For example, when the distance from the center of the rotation axis to the shutter side abutting portion 145 is constant, the moving amount of the interface member 120 must be set longer than that in the embodiment. FIG. 16C shows the state in which the cartridge B has been completely inserted. In the state, the sliding surface abutting portion 143 of the shutter link member 142 has reached the uppermost, flat portion of the sliding surface 124 of the interface member 120. In other words, the shutter push-up portion 144 is at the uppermost portion, and the base side of the shutter side abutting portion 145 is lifted to the uppermost position. At the time, the fixing entrance shutter 140 is in a completely open state.

As described above, the manner of switching the contact between the shutter push-up portion 144 and the shutter side abutting portion 145 in the embodiment is for the purpose of further reducing the size of the apparatus main body A. Therefore, when there is a sufficient space for the interface member 120 and the shutter link member 142 to operate, or when the shutter push-up portion 144 of the shutter link member 142 can be raised to a sufficient level to contact the tip end side of the shutter side abutting portion 145 of the fixing entrance shutter 140 in FIG. 16C, such switching of the contact is not necessary.

As in the foregoing, by operating in conjunction with the cartridge presence/absence detecting mechanism and the fixing entrance shutter mechanism by the single interface member, the space can be saved and the number of components can be reduced, so that the cost can be reduced.

According to the embodiment, the interface member 120 moves linearly, the cartridge presence/absence detecting mechanism is a link mechanism capable of linear and pivoting movement using an engagement groove, and the fixing entrance shutter mechanism is a link mechanism using a sliding surface. However, the interlocking mechanism through a single interface member is not limited by the configuration according to the described embodiment. The operation of the mechanisms when the cartridge B is detached from the mounted state corresponds to operation carried out in the reversed order from the above. The operation will not be described.

Second Embodiment

Hereinafter, a second embodiment of the present invention will be described in detail in conjunction with the drawings. In the following case according to the second embodiment, the operation in conjunction with the paper width detecting mechanism (not shown) is not necessary. Since the configurations of the image forming apparatus main body A and the cartridge B, the image forming process, and the operation of inserting and removing the cartridge B are the same as those according to the first embodiment, a description thereof will not be provided. The matters not specifically described in the description of the second embodiment are the same as those according to the first embodiment.

Figure 17:
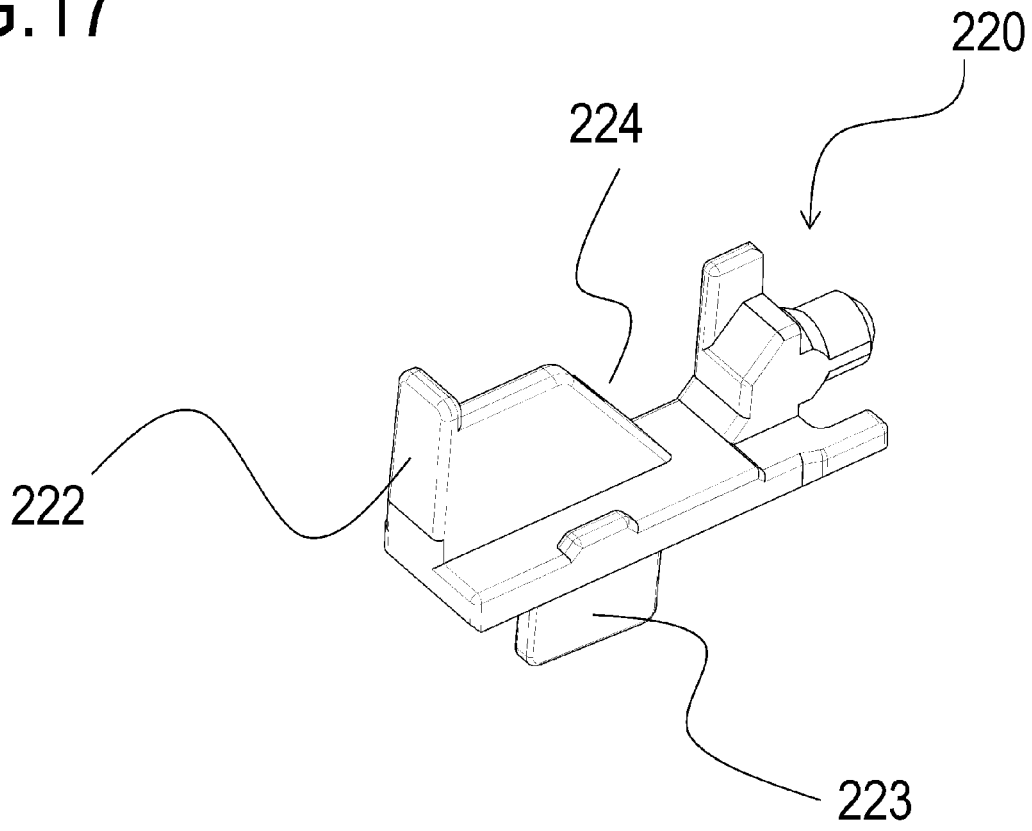
FIG. 17 is a view for illustrating an interface member according to a second embodiment of the invention.
Figure 17:
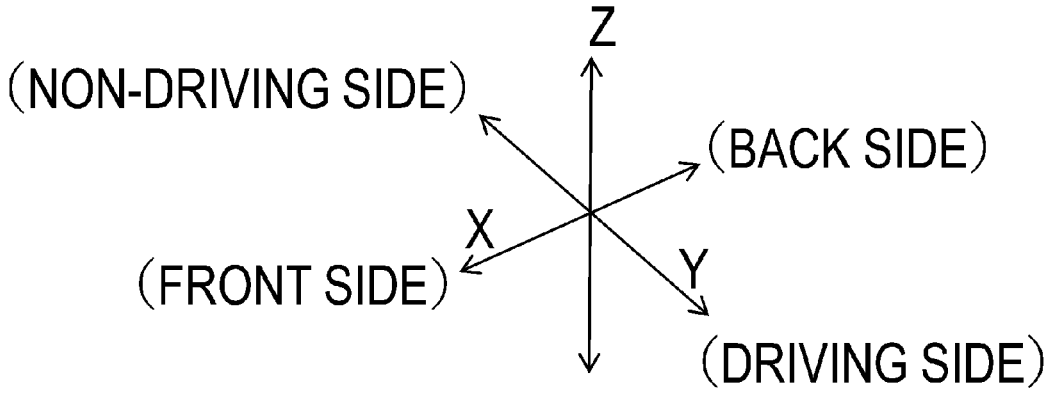
Figure 18A:
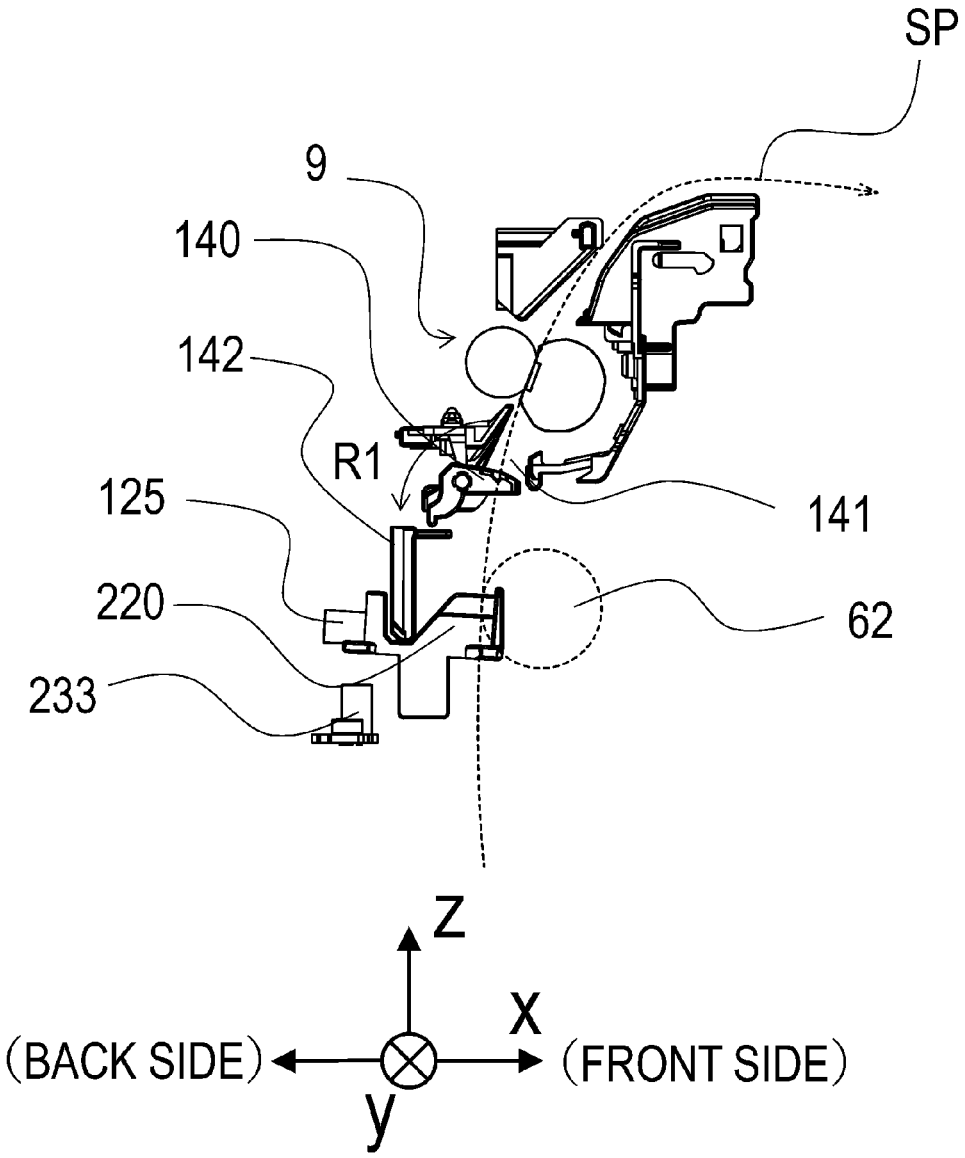
FIG. 18A is a view for illustrating the state in which a cartridge according to the second embodiment is not inserted.
Figure 18B:
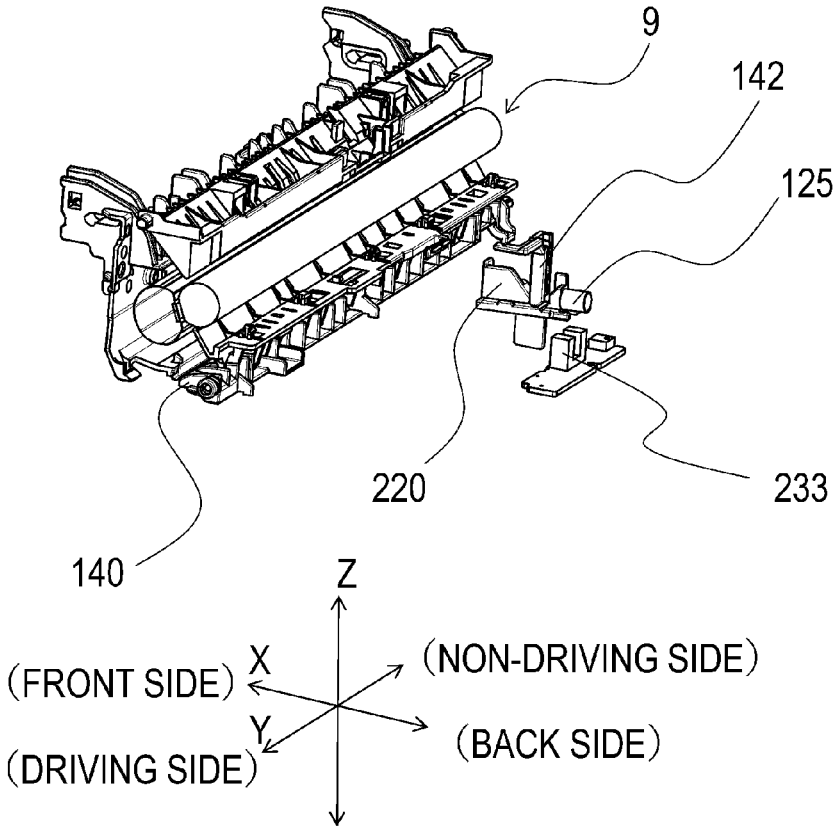
FIG. 18B is a view for illustrating the state in which the cartridge according to the second embodiment is not inserted.

Configurations of Cartridge Presence/Absence Detecting Mechanism and Fixing Entrance Shutter Mechanism The configuration of the cartridge presence/absence detecting mechanism will be described with reference to FIGS. 17 and 18B. FIG. 17 is a view for illustrating a single component in an interface member 220 according to the second embodiment of the present invention. FIGS. 18A and 18B show the state in which the cartridge B is not inserted. FIG. 18A is a view from the left side of the apparatus main body A, and FIG. 18B is a view from diagonally right behind the apparatus main body A. In order to make the part related to the present invention visible, FIGS. 18A and 18B do not show parts which are not related to the present invention such as the conveying guide 91.

The conveying guide 91 of the apparatus main body A has the interface member 220 capable of substantially linear motion with respect to the direction in which the cartridge B is inserted. The interface member 220 has a main body side abutting portion 222 for abutting against the cartridge-side protrusion 102.

The interface member 220 has a light-shielding portion 223. The apparatus main body A is also provided with a photo-interrupter 233, the optical axis of which is switched between transmission and shielding (not shown) by the light-shielding portion 223. The part is the cartridge presence/absence detecting mechanism in the embodiment.

The conveying guide 91 has a fixing entrance shutter mechanism at a fixing entrance 141 through which a sheet PA is conveyed to the fixing apparatus 9. The fixing entrance shutter mechanism is the same as that according to the first embodiment including the sliding surface 224 provided in the interface member 220, and therefore a description of thereof will not be provided.

Similarly to the first embodiment, the interface member 220 according to the embodiment is constantly biased by the biasing member 125 such as a spring in the direction opposite to the direction in which the cartridge B is inserted.

Similarly to the first embodiment, the fixing entrance shutter 140 according to the embodiment is constantly biased in the direction of the arrow R1 by biasing member which is not shown.

Interlocking Operation Between Cartridge Presence/Absence Detecting Mechanism and Fixing Entrance Shutter Mechanism Interlocking between the cartridge presence/absence detecting mechanism and the fixing entrance shutter mechanism will be described in detail with reference to FIGS. 18A, 18B, 19A, and 19B.

To start with, the state in which the cartridge B is not inserted in the apparatus main body A will be described with reference to FIGS. 18A and 18B. The interface member 220 in the protruding position as the main body side abutting portion 222 is biased by the biasing member 125 in the opposite direction to the direction in which the cartridge B is inserted. At the time, the light-shielding portion 223 is in the position in which the optical axis (not shown) of the photo-interrupter 233 attains a transmission state. The dashed arrow SP indicates a sheet conveyance path. In other words, when the cartridge B is not inserted, the fixing entrance shutter 140 is in the position to block the conveyance path. Since the fixing entrance shutter mechanism is the same as that according to the first embodiment described above, a description thereof will not be provided.

Figure 19A:
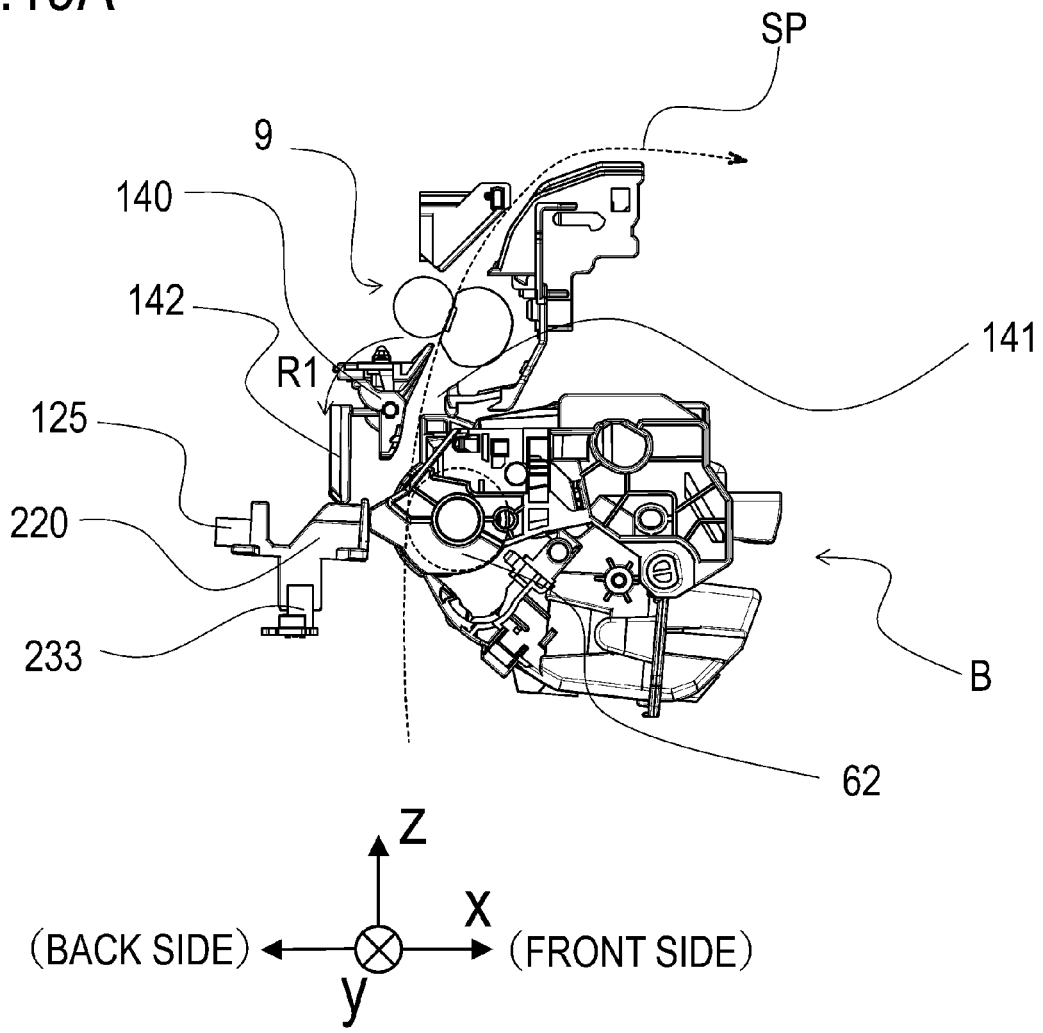
FIG. 19A is a view for illustrating the state in which the cartridge according to the second embodiment is inserted.
Figure 19B:
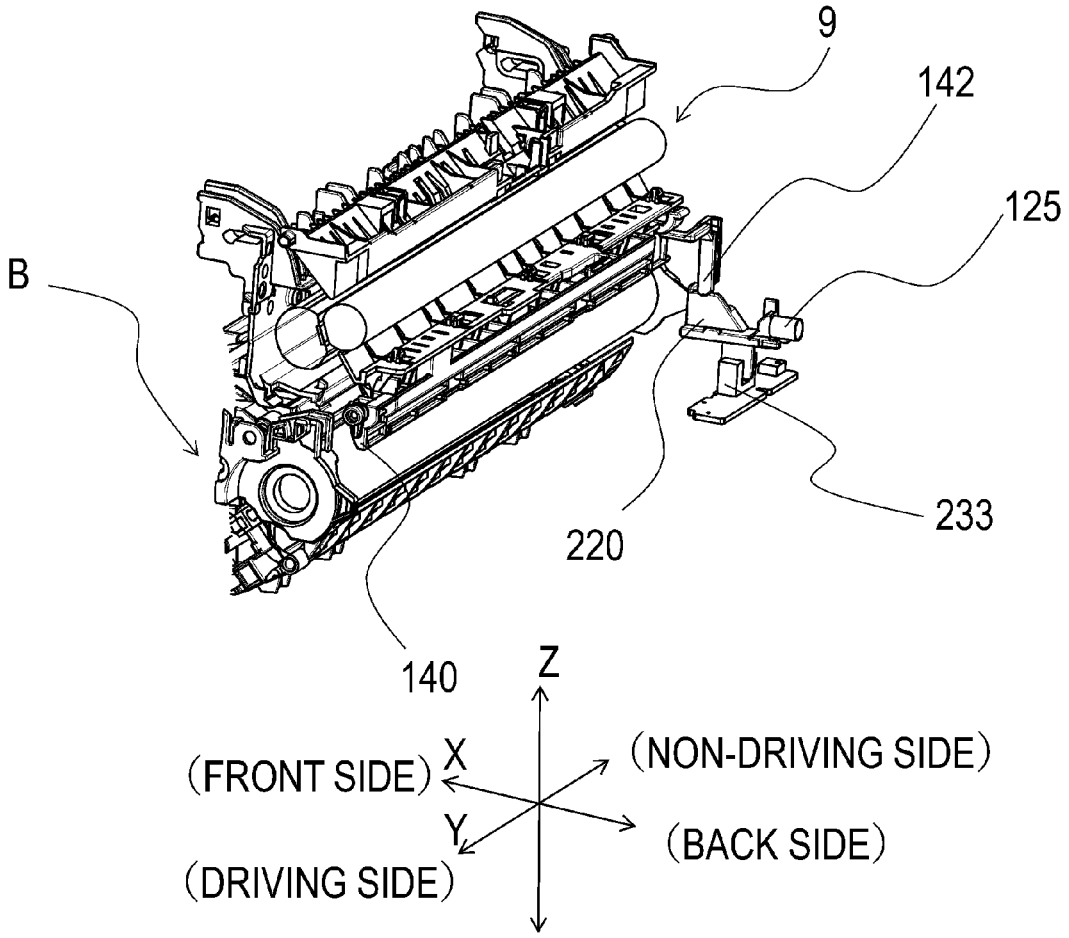
FIG. 19B is a view for illustrating the state in which the cartridge according to the second embodiment is inserted.

Next, the state in which the cartridge B is inserted into the apparatus main body A will be described with reference to FIGS. 19A and 19B. FIG. 19A is a view from the left side of the apparatus main body A. FIG. 19B is a view from diagonally right behind the apparatus main body A. In order to make the part related to the present invention visible, FIGS. 19A and 19B do not show parts which are not related to the present invention such as the conveying guide 91.

When the cartridge B is inserted into the apparatus main body A, the protrusion 102 on the cartridge side pushes in the main body side abutting portion 222, and the interface member 220 moves in the direction in which the cartridge B is inserted similarly to the first embodiment described above.

As described above, the interface member 220 is provided with a light-shielding portion 223, and as the cartridge B is inserted, the light-shielding portion 223 also moves. When the cartridge B is completely inserted (FIGS. 19A and 19B), the part moves to the position in which the optical axis (not shown) of the photo-interrupter 233 attains a shielding state.

As described above, the fixing entrance shutter mechanism is the same as that according to the first embodiment including the sliding surface 224 of the interface member 220. Similarly to the first embodiment described above, when the cartridge B is inserted, the fixing entrance shutter 140 rotates and the fixing entrance 141 attains a completely open state.

As described above, according to the embodiment, even when operation in conjunction with the paper width detecting mechanism is not necessary, the cartridge presence/absence detecting mechanism and the fixing entrance shutter mechanism can be operated in a manner in conjunction with each other by a single interface member, so that the space can be saved and the number of components can be reduced, so that the cost can be reduced.

According to the embodiment, the interface member 220 is capable of linear motion, and the fixing entrance shutter mechanism is a cam mechanism using a sliding surface. However, the interlocking mechanism through the single interface member is not limited by the configuration according to the described embodiment.

According to the embodiment, the interface member 220 is provided with the light-shielding portion 223, but the shutter link member 142 or the fixing entrance shutter 140 may be provided with the light-shielding portion.

Third Embodiment

A third embodiment of the present invention will be described according to the drawings. The feature of the third embodiment is the operating in conjunction with the cartridge presence/absence detecting mechanism and the paper width detecting mechanism.

A sheet width and attachable/detachable unit presence/absence detecting mechanism provided in an image forming apparatus according to a third embodiment of the present invention will be described with reference to FIGS. 1, 20 to 22A, 22B, 23A, 23B, and 24.

Image Forming Apparatus

With reference to FIG. 1, the image forming apparatus according to the third embodiment of the present invention will be described. FIG. 1 is a schematic sectional view of a general configuration of the image forming apparatus according to the embodiment.

As shown in FIG. 1, in the image forming apparatus 100 according to the embodiment, a sheet PA as a recording material stored in a sheet tray 4 is set on a sheet raising unit, which raises the sheet PA to the position of the pickup roller 5*a* and the feed roller 5*b* which are paper feeding portions provided in the image forming apparatus 100. When printing is carried out on the sheet PA placed on the sheet raising unit which is not shown in the image forming apparatus 100 in the embodiment, the sheet PA passes from the pickup roller 5*a* and the feed roller 5*b* through a conveying roller pair 5*c* to a transfer portion between the drum 62 and the transfer roller 27, and after an image is formed, the sheet is passed through the conveyance path including the fixing apparatus 9 as the fixing portion and discharged from the discharge roller pair 10 as a paper discharge portion to the discharge tray 11. A controller 200 as a control unit which controls various kinds of operations by the image forming apparatus 100 detects the sheet width and the presence/absence of the attachable/detachable unit on the basis of the light receiving state of an optical sensor by the sheet width and attachable/detachable unit presence/absence detecting mechanism which will be described below.

Sheet Width and Detachable Unit Presence/Absence Detecting Mechanism

Figure 20:
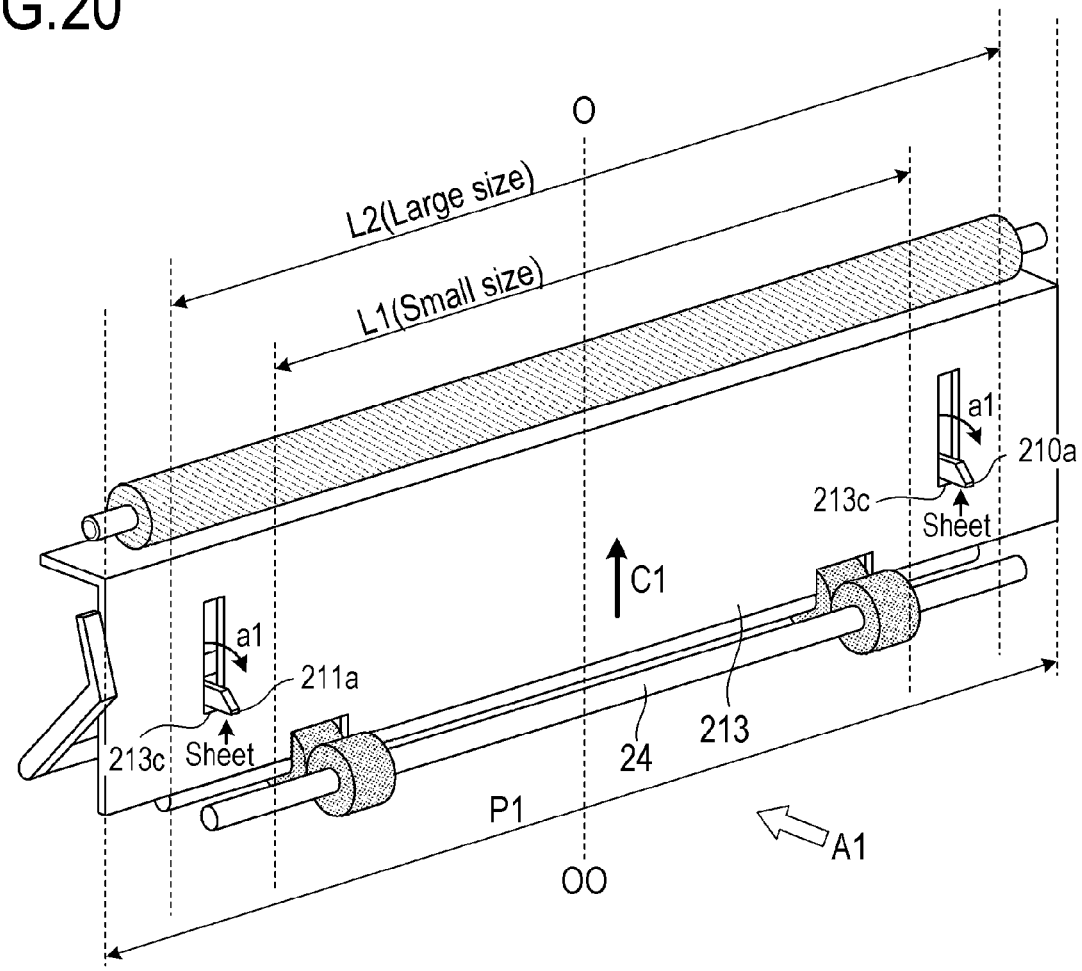
FIG. 20 is a front perspective view of a sheet width and attachable/detachable unit presence/absence detecting mechanism according to the third embodiment.
Figure 21:
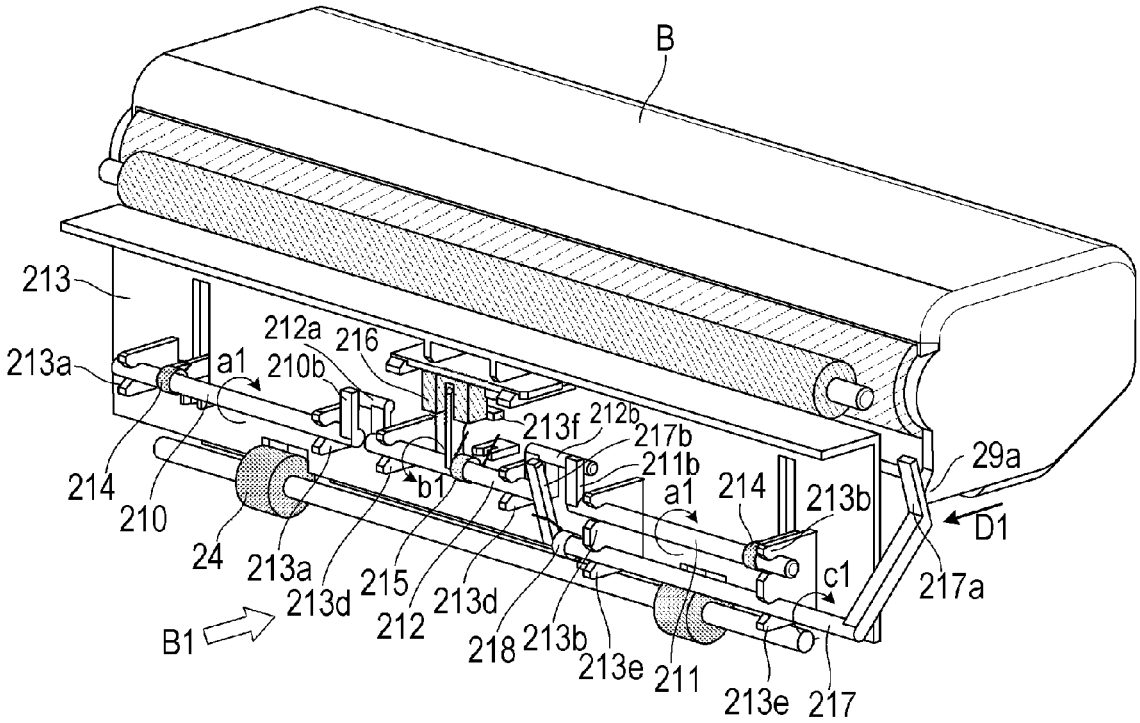
FIG. 21 is a rear perspective view of the sheet width and attachable/detachable unit presence/absence detecting mechanism according to the third embodiment.

With reference to FIGS. 20 and 21, a general configuration of the sheet width and attachable/detachable unit presence/absence detecting mechanism according to the third embodiment will be described. FIG. 20 is a perspective view of the area indicated by X in the image forming apparatus 100 in FIG. 1 when viewed obliquely from the arrow A1 side or the front side of the main body showing the conveyance path including sheet width detecting unit. FIG. 21 is a perspective view of the area indicated by X when viewed obliquely from the arrow B1 side as the back side of the main body showing the sheet width detecting unit and the attachable/detachable unit presence/absence detecting mechanism according to the embodiment.

In FIG. 20, P1 represents a conveyance path for a sheet PA from the conveying roller pair 5*c* to the transfer portion, L1 indicates a conveying area for a small-size sheet, and L2 indicates a conveying area for a large-size sheet (the maximum size which can be guided). It is assumed that sheets are conveyed in this conveyance path P1 so that the centers of the widthwise directions (the directions orthogonal to the conveying direction C1) of the two types of sheets PA, a small-size sheet L1 and a large-size sheet L2, coincide with the conveyance reference O-OO in the conveyance path P1.

A first lever 210 and a second lever 211 in FIG. 21 are rotatably held by the first lever holder 213*a* and the second lever holder 213*b* of a conveying guide 213 as a guide member and are provided in different positions across the transfer reference O-OO in the direction orthogonal to the conveying direction C1. The first lever 210 and the second lever 211 as first moving members are biased in the direction of the arrow al by lever springs 214 as biasing members, and the rotation force is stopped by a rotation stopper 213*c* provided at the conveying guide 213 in FIG. 20.

In FIG. 20, when the sheet PA is conveyed to the area of the first lever 210 or the second lever 211 which protrudes from the guide surface 213 of the conveying guide 213, the sheet PA contacts (abuts against) the contact portion 210*a* of the first lever 210 on one end side in the width-wise direction or the contact portion 211*a* of the second lever 211 on the other end side. As being pushed by the sheet PA, the first lever 210 or the second lever 211 pivots in the direction opposite to the arrow al. When the sheet PA has been passed, the first lever 210 or the second lever 211 pivots in the direction of the arrow al by the biasing force of the lever spring 214, and is stopped by contacting the rotation stopper 213*c* of the conveying guide 213 as a restricting portion. The rotation stopper 213*c* functions as a restricting portion which restricts the range of rotational movement of the first lever 210 and the second lever 211 after the rotation phase in which the sensor flag 212 stays in a prescribed light-shielding position.

Figure 22A:
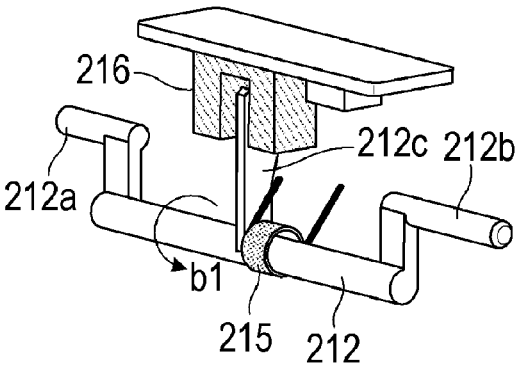
FIGS. 22A and 22B are perspective views of a sensor flag according to the third embodiment.
Figure 22B:
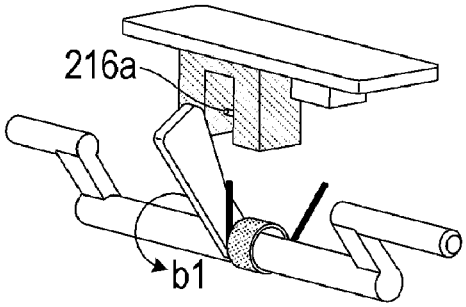

With reference to FIGS. 21, 22A, and 22B, the operation of the sensor flag 212 as a flag member will be described. FIGS. 22A and 22B are perspective views showing an enlarged view of the area around the sensor flag 212 and a photo-interrupter 216 in FIG. 21. The sensor flag 212 is rotatably held by the sensor flag holder 213*d* of the conveying guide 213 and is biased in the direction of the arrow b1 (a first rotation direction), which is opposite to the arrow al (a second rotation direction), by a sensor flag spring 215 as a biasing member. The rotation force in the direction of the arrow b1 is stopped as an arm 212*a* contacts an engagement portion 210*b* of the first lever 210, and the rotation force in the direction of the arrow b1 is stopped as an arm 212*b* contacts an engagement portion 211*b* of the second lever 211 similarly to the arm 212*a*.

When the large-size sheet L2 is conveyed in the conveyance path P1, the tip end of the sheet PA contacts the contact portions 210*a* and 211*a* of the first and second levers 210 and 211. This causes both the first and second levers 210 and 211 to rotate in the opposite direction to the arrow al, and the rotation force of the sensor flag 212 which has been stopped at the arms 212*a* and 212*b* is released. At the time, the sensor flag 212 rotates in the direction of the arrow b1 together with the first and second levers 210 and 211 by the biasing force of the sensor flag spring 215. The rotation force of the sensor flag 212 in the direction of the arrow b1 due to the biasing force of the sensor flag spring 215 is smaller than both the rotation force of the first lever 210 in the direction of the arrow al and the rotation force of the second lever 211 in the direction of the arrow al due to the biasing force of the lever springs 214.

Therefore, the sensor flag 212 can be rotated in the direction of the arrow b1 only when both the first lever 210 and the second lever 211 are rotated in the direction opposite to the arrow al, and when only one of the first lever 210 and the second lever 211 is rotated in the direction opposite to the arrow al, one of the arms 212*a* and 212*b* is kept stopped with the engagement portion 210*b* of the first lever 210 or the engagement portion 211*b* of the second lever 211, and therefore the sensor flag 212 is not rotated in the direction of the arrow b1.

FIG. 22A shows the sensor flag 212 in the position (the light-shielding position) where the first lever 210 and the second lever 211 are engaged with the rotation stopper 213*c* of the conveying guide 213. The light-shielding portion 212*c* of the sensor flag 212 shields the optical axis 216*a* of the photo-interrupter 216 as an optical sensor, so that the signal from the photo-interrupter 216 attains a "light-shielded (OFF)" state. The position of the first lever 210 and the second lever 211 at the time is referred to as the "first position" and the position of the sensor flag 212 is referred to as the "standby position" (non-paper passing position).

In FIG. 22B, the large-size sheet L2 is conveyed in the conveyance path P, the first lever 210 and the second lever 211 are rotated in the direction opposite to the arrow al in FIG. 3, and the sensor flag 212 is rotated in the direction of the arrow b1 (in the first transmission position). At the time, the light-shielding portion 212*c* of the sensor flag 212 is positioned away from the optical axis 216*a* of the photo-interrupter 216 and does not shield the optical axis 216*a*, so that light from the light-emitting part can be received by the light-receiving part, and the signal from the photo-interrupter 216 attains a "transmission (ON)" state. The position of the first lever 210 and the second lever 211 at the time is referred to as the "second position," and the position of the sensor flag 212 is referred to as the "paper passing position".

While the large-size sheet L2 is passed through, the contact part 210*a* of the first lever 210 and the contact part 211*a* of the second lever 211 continue to contact the sheet PA, so that the rotation state of the first lever 210 and the second lever 211 is maintained, and the signal from the photo-interrupter 216 maintains the "transmission (ON)" state. In this way, it can be determined that the large-size sheet L2 is conveyed on the basis of the transition of the signal from the photo-interrupter 216 from the "light shielding (OFF)" state to the "transmission (ON)" state.

Figure 23A:
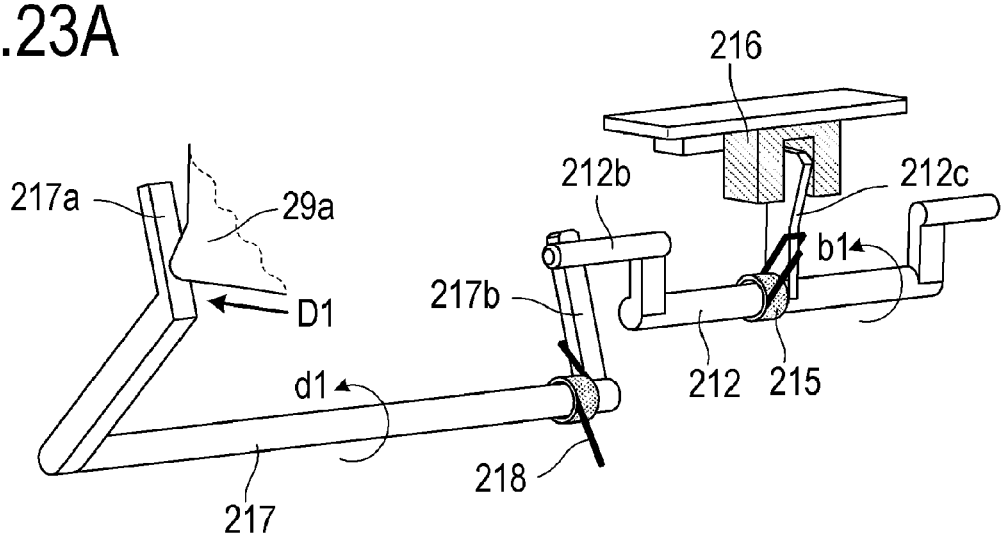
FIGS. 23A and 23B are front perspective views of the sensor flag and an attachable/detachable unit according to the third embodiment.
Figure 23B:
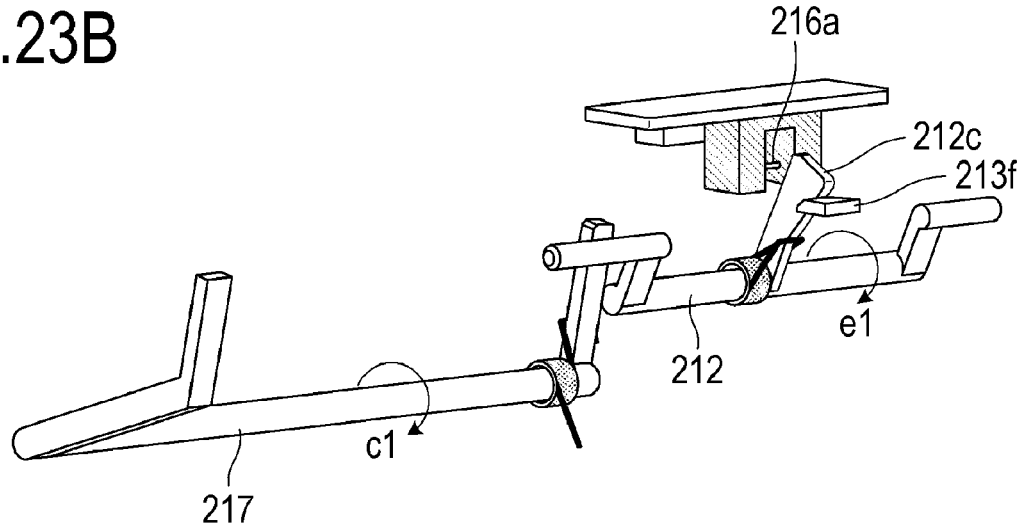

When the first and second levers 210 and 211 return to the standby position from the paper passing position after the large-size sheet L2 has been passed through, the sensor flag 212 returns from the paper passing position in FIG. 23B to the standby position in FIG. 22A, and the signal from the photo-interrupter 216 returns from "transmission (ON)" to "light shielding (OFF). When the small-size sheet L1 is conveyed, the first and second levers 210 and 211 do not rotate, so that the position of the sensor flag 212 remains in the standby position in FIG. 22A, and it can be determined that the small-size sheet L1 is conveyed while the sheet PA is in the process of passing the conveyance path P, since the "light shielding (OFF)" state of the signal from the photo-interrupter 216 is maintained. The following Table 1 shows combinations of signals from the photo-interrupter 216 in the respective position states of the first lever 210, the second lever 211, and the sensor flag 212 according to the embodiment.

TABLE 1

| First lever 210 | Second lever 211 | Sensor flag 212 | Photo-interrupter 216 | Sheet size determination result |
|---|---|---|---|---|
| Standby | Standby | Standby | Light shielding | L1(Small size) |
| Paper passing | Standby | Standby | Light shielding | L1(Small size) |
| Standby | Paper passing | Standby | Light shielding | L1(Small size) |
| Paper passing | Paper passing | Paper passing | Transmission | L2(Large size) |

With reference to FIGS. 21, 23A and 23B, the configuration and operation of the mechanism for detecting the presence/absence of an attachable/detachable unit such as a cartridge B will be described. FIGS. 23A and 23B are perspective views of the sensor flag 212, the photo-interrupter 216, and a third lever 217 as viewed obliquely from the arrow A1 side as the front side of the main body.

As shown in FIG. 21, the third lever 217 as the second moving member is rotatably held by the third lever holder 213*e* of the conveying guide 213 and is biased in the direction of the arrow cl by a third lever spring 218. FIG. 23A shows the relation between the sensor flag 212 and the third lever 217 in the standby position (the mounting position) as the fourth position.

When the cartridge B is inserted into the image forming apparatus 100, the pressing part 29*a* of the cartridge B contacts and pushes the detection part 217*a* of the third lever 217 in the direction of the arrow D1, which causes the third lever 217 to rotate in the direction of the arrow dl, which is opposite to arrow cl. As a result, the contact portion 217*b* moves to a retreated position, which is separated from the arm 212*b* in the direction of the arrow b1 (the first rotation direction). At the time, since the arm 212*b* of the sensor flag 212 and the contact part 217*b* of the third lever 217 do not contact each other, the sensor flag 212 rotates in the direction of the arrow b1 by the biasing force of the sensor flag spring 215. As a result, the sensor flag 212 stops in the standby position and the signal from the photo-interrupter 216 attains a "light shielding (OFF)" state because the sensor flag 212 is engaged with the contact part 210*a* of the first lever 210 and the contact part 211*a* of the second lever 211.

Next, the operation of the sensor flag 212 and the third lever 217 when the cartridge B is not inserted will be described with reference to FIG. 23B.

When the cartridge B is not inserted, no pressing force from the pressing portion 29*a* of the cartridge B is applied to the detection part 217*a* of the third lever 217, and therefore the third lever 217 rotates in the direction of the arrow cl by the biasing force of the third lever spring 218. At the time, the third lever 217 contacts the arm 212*b* of the sensor flag 212 at the arm 212*a*, which causes the sensor flag 212 to rotate in the direction of the arrow el (the second rotation direction), which is opposite to the direction of arrow b1.

When the sensor flag 212 contacts the rotation stopper 213*f* of the conveying guide 213 shown in FIG. 23B, the rotation of the third lever 217 in the direction of the arrow cl is stopped. At the time, the light-shielding portion 212*c* of the sensor flag 212 moves away from the optical axis 216*a* of the photo-interrupter 216, which releases the "light-shielding (OFF)" state of the optical axis 216*a*, and the signal from the photo-interrupter 216 attains a "transmission (ON)" state. When the sensor flag 212 rotates in contact with the third lever 217 and the signal from the photo-interrupter 216 attains a "transmission (ON)" state, the position of the first lever 210, the second lever 211, the sensor flag 212, and the third lever 217 is the "detection position" (the non-mounting position) as the third position.

Figure 24:
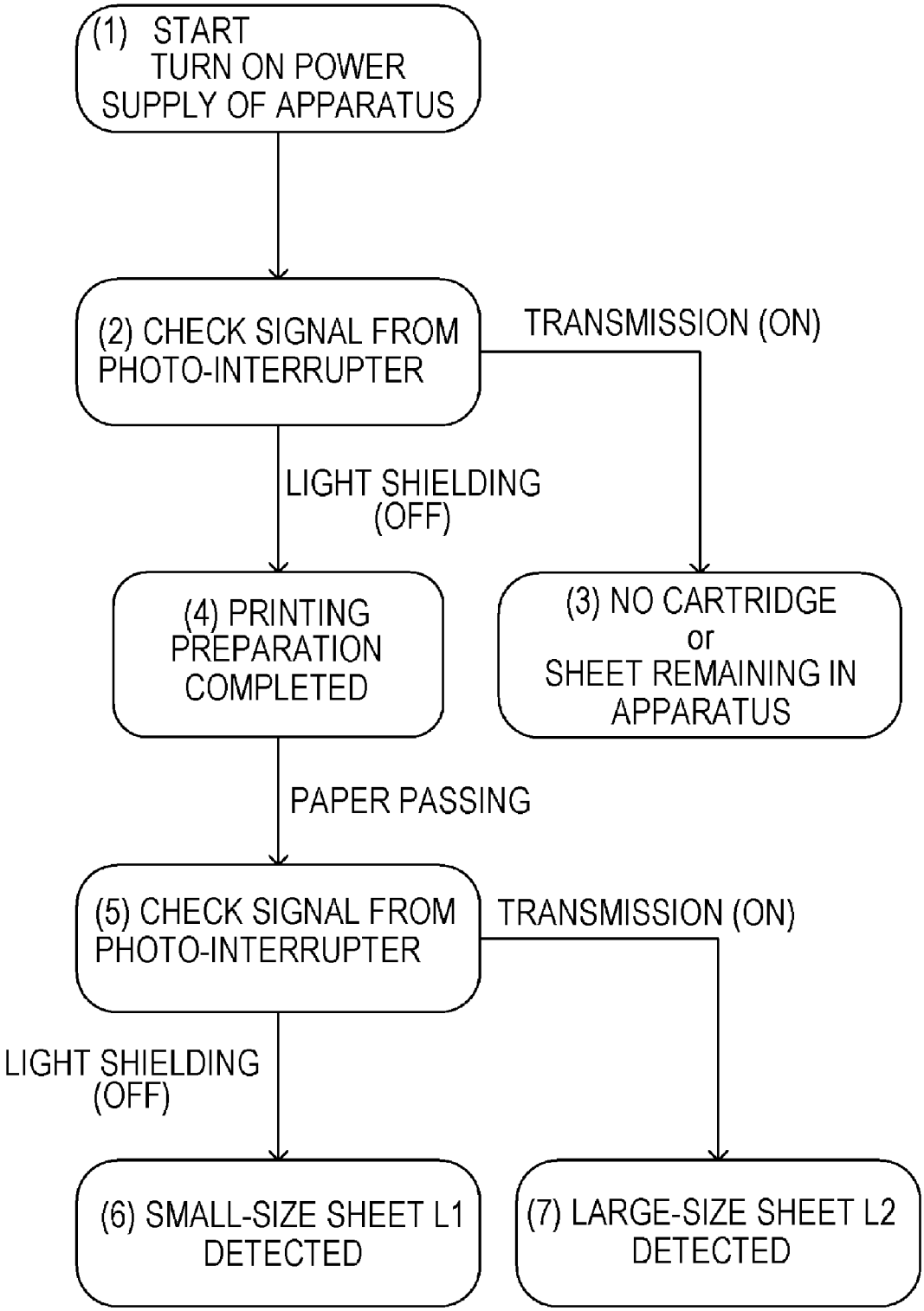
FIG. 24 is a flow chart for illustrating the process from activation of the apparatus to sheet width determination according to the third embodiment.

With reference to FIG. 24 and Table 2, how to determine inserted and non-inserted states of the cartridge B and how to detect the size in the width-wise direction of the conveyed sheet PA (determination of L1 and L2) according to the embodiment will be described. FIG. 24 is a flowchart for illustrating the process from turning on of the power supply of the image forming apparatus 100 to the determination of the size in the width-wise direction of the conveyed sheet PA. Table 2 indicates the positional relation among elements in each item in the flowchart in FIG. 24 and determination carried out by the image forming apparatus 100 depending on the situation. Item numbers (1) to (7) in the flowchart in FIG. 24 correspond to the numbers in Table 2.

TABLE 2

| No. | First lever 210 | Second lever 211 | Sensor flag 212 | Third lever 217 | Photo-interrupter 216 | Determination |
|---|---|---|---|---|---|---|
| (1), (2) | — | — | — | — | — | — |
| (3) | Standby or Paper passing | Standby or Paper passing | Detection or Paper passing | Detection or Standby | Transmission | No cartridge or sheet remaining in apparatus |
| (4), (5) | Standby | Standby | Standby | Standby | Light shielding | Cartridge inserted and no sheet remaining in apparatus |
| (6) | Standby | Standby | Standby | Detection | Light shielding | Small-size sheet L1 |
| (7) | Paper passing | Paper passing | Paper passing | Detection | Transmission | Large-size sheet L2 |

When the power supply of the image forming apparatus 100 is turned on in (1) in FIG. 24, the image forming apparatus 100 checks the state of a signal from the photo-interrupter 216 in (2). When the signal from the photo-interrupter 216 which is detected for the first time corresponds to a "transmission (ON)" state, then the sensor flag 212 is the state in (3), i.e., either in the detection position (FIG. 23B) or in the paper passing position (FIG. 22B). In this case, the following two situations can be assumed.

Cartridge not Inserted

The cartridge B is not inserted in the image forming apparatus 100, and the third lever 217 is in the detection position, which causes the sensor flag 212 to rotate to the detection position (FIG. 23B) in the direction of the arrow e in FIG. 23B, so that the signal from the photo-interrupter 216 attains a "transmission (ON)" state.

Sheet Remaining in Image Forming Apparatus

When the image forming apparatus 100 stops operating during conveyance of a sheet PA because of any extraneous factor or an operation failure, and the sheet PA remains or stops in the conveyance path P1, the first lever 210 and the second lever 211 may be pushed by the sheet PA to rotate in the direction opposite to the direction of the arrow al in FIG. 21. As a result, the engagement of the sensor flag 212 by the first lever 210 and the second lever 211 is released, the sensor flag 212 rotates in the direction of the arrow b1 to the paper-passing position (FIG. 23B), and the signal from the photo-interrupter 216 attains a "transmission (ON)" state.

As described above, when the image forming apparatus 100 recognizes the state (3) in FIG. 45, the operator needs to insert a toner cartridge or remove the sheet PA remaining in the apparatus, and the image forming apparatus 100 can prompt the operator to perform either of these tasks for example by the display.

In the image forming apparatus 100 with a C-path shape as shown in FIG. 1, it is necessary to open an opening/closing door provided at the front of the apparatus for both insertion and removal of the cartridge B and removal of the remaining sheet PA. When the opening/closing door is opened in response to an instruction for example from the display of the image forming apparatus 100, the operator can visually check whether the cartridge B is present, and when the cartridge B is inserted but preparation for printing is not yet complete, the operator can immediately determine that the sheet PA is still in the apparatus.

When the state of the signal from the photo-interrupter 216 is checked in (2) in FIG. 24, and if the signal is in a "light shielding (OFF)" state, the sensor flag 212 is in the standby position (FIG. 22A), which is the state (4). This is limited to the situation where the first lever 210 and the second lever 211 are in the standby position and the third lever 217 is rotated from the detection position (FIG. 23B) to the standby position (FIG. 23A).

Therefore, it can be determined that the cartridge B is inserted in the image forming apparatus 100 and that the sheet PA remaining in the apparatus is at least not in the range of the rotation trajectory of the first lever 210 and the second lever 211. In this situation, the image forming apparatus 100 determines for the first time that printing preparation (preparation for image forming operation) has been completed. After the state (4), when printing starts and the sheet PA reaches the conveyance path P1, the state of the signal from the photo-interrupter 216 is checked again. At the time, when the signal from the photo-interrupter 216 remains in the "light shielding (OFF)" state even though a sufficient time period has passed for the sheet PA to reach the positions of the first and second levers 210 and 211, the image forming apparatus 100 determines that the passed sheet PA is a small-size sheet L1.

On the other hand, in (5), when the signal from the photo-interrupter 216 is in the "transmission (ON)" state, the first lever 210 and the second lever 211 contact the sheet PA and rotate, and the disengaged sensor flag 212 rotates to the paper-passing position (FIG. 22B). Therefore, the image forming apparatus 100 determines that the conveyed sheet PA is a large-size sheet L2.

According to the embodiment, the following advantages are provided in the sheet width and attachable/detachable unit presence/absence detecting mechanism in the image forming apparatus.

In an image forming apparatus provided with a sheet width detecting mechanism and a photo-interrupter corresponding to the sheet width detection, a lever member is provided to detect the presence or absence of an attachable/detachable unit such as a toner cartridge that can be attached to or detached from the main body of the apparatus, and by operating the member in conjunction with the sheet width detecting mechanism, the presence or absence of the attachable/detachable unit can be detected without providing a new dedicated photo-interrupter. In this way, the configuration of the image forming apparatus can be simplified and the cost can be reduced.

According to the embodiment, it cannot be determined whether printing preparation is not complete in state (3) in FIG. 24 because the cartridge B is not inserted or because the sheet PA remains inside the image forming apparatus 100. However, when the embodiment is combined with the signal state of another photo-interrupter provided for a different purpose, it can be determined which state the image forming apparatus 100 is in in the state (3).

For example, many image forming apparatuses are provided with a sheet tip end detecting lever for detecting the tip end position of a sheet PA and a corresponding photo-interrupter in the range in which the first lever 210 and the second lever 211 are provided in the conveyance path P1. In the state in (3), when the signal from the photo-interrupter for detecting the tip end position of the sheet is a signal corresponding to the paper-passing position of the sheet tip end detecting lever, the sheet tip end detecting lever contacts the sheet PA to move, indicating that the lever is in the paper-passing position. Therefore, it can be determined that the signal from photo-interrupter 216 is in the "transmission (ON)" state, not because the cartridge B is not inserted, but because the sheet PA remains in the conveyance path P1.

Meanwhile, in the state (3), when the signal from the photo-interrupter for detecting the sheet tip end position is a signal corresponding to the standby position of the sheet tip end detecting lever, it is unlikely that there is any sheet PA remaining in the conveyance path P1, and it can be determined that the cartridge B is not inserted.

According to the embodiment, the signal from the photo-interrupter 216 in the standby position as one position is in the "light shielding (OFF)" state and the signal from the photo-interrupter 216 in the paper passing position and detection position as the other position is in the "transmission (ON)" state, but the invention is not limited by this. When the shape of the light-shielding portion 212*c* of the sensor flag 212 is changed, the standby position as the other position may be set to correspond to the "transmission (ON)" state and the paper-threading position and the detection position to one position to the "light-shielding (OFF)" state.

According to the embodiment, the cartridge B is used as an example of the attachable/detachable unit to be attached to and detached from the image forming apparatus 100, and detection of the detached/attached state of the cartridge B has been described, but the attachable/detachable unit according to the present invention is not limited to the cartridge B. For example, the invention can be applied to detection of the insertion/withdrawal state of the sheet tray 4, which is loaded with sheets PA and can be inserted to and removed from the image forming apparatus 100. Furthermore, the invention can be applied to detection of any detection state other than the detection of the detached/attached state of the attachable/detachable unit. For example, the invention can be applied to detection of the open/closed state of a door member that can be opened and closed with respect to the image forming apparatus 100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2020-102724, filed on Jun. 12, 2020, and No. 2020-102666, filed on Jun. 12, 2020, which are hereby incorporated by reference herein in their entirety.

What is claimed is:

1. An image forming apparatus for forming an image on a recording material, comprising:

an apparatus main body;

an attachable/detachable unit that is attachable to/detachable from the apparatus main body;

an optical sensor comprising a light-emitting portion and a light-receiving portion;

a flag member capable of rotating around a rotation axis between a transmission position in which light from the light-emitting portion is allowed to be received by the light-receiving portion and a light-shielding position in which the light is not allowed to be received by the light-receiving portion;

a flag spring configured to bias the flag member so as to rotate the flag member in one direction;

a first sheet moving member provided on one end side of the flag member in a direction of the rotation axis, the first sheet moving member capable of moving between a first position which is a position not in contact with the recording material and a second position which is a position in contact with the recording material;

a second sheet moving member provided on another end side of the flag member in the direction of the rotation axis, the second sheet moving member capable of moving between a third position which is a position not in contact with the recording material and a fourth position which is a position in contact with the recording material;

a lever provided on the one end side of the flag member in the direction of the rotation axis, the lever capable of moving between a non-contact position which is a position not in contact with the attachable/detachable unit and a contact position which is a position in contact with the attachable/detachable unit;

wherein rotation by the flag spring in the one direction of the flag member is restricted by contact of the flag member with the first sheet moving member at the first position and the second sheet moving member at the third position, and wherein in a state where the flag member contacts with both the first sheet moving member at the first position and the second sheet moving member at the third position, the flag member rotates in a direction opposite to the one direction by pushing of the lever which moves from the contact position to the non-contact position.

2. The image forming apparatus according to claim 1, wherein in a state where the flag member contacts both the first sheet moving member at the first position and the second sheet moving member at the third position, the flag member is positioned at the light-shielding position.

3. The image forming apparatus according to claim 2, wherein the flag member at the light-shielding position moves to the transmission position by pushing of the lever which moves from the contact position to the non-contact position.

4. The image forming apparatus according to claim 3, wherein in a case where the first sheet moving member at the first position moves to the second position and the second sheet moving member stays at the third position, rotation by the flag spring in the one direction of the flag member is restricted by contact of the flag member with the second sheet moving member at the third position.

5. The image forming apparatus according to claim 1, wherein in the direction of the rotational axis, a region in which the lever contacts with the attachable/detachable unit is positioned on the one end side of the first sheet moving member.

6. The image forming apparatus according to claim 1, wherein in the direction of the rotational axis, a region in which the lever contacts with the flag member is positioned on the another end side of a region at which the first sheet moving member contacts with the flag member.

* * * * *